US011291997B2

(12) United States Patent
Henry et al.

(10) Patent No.: US 11,291,997 B2
(45) Date of Patent: Apr. 5, 2022

(54) ROTARY MANIFOLD FOR PAPER-BASED IMMUNOASSAYS

(71) Applicants: Colorado State University Research Foundation, Fort Collins, CO (US); The United States of America, as represented by the Secretary of Agriculture, Fort Collins, CO (US)

(72) Inventors: Charles S. Henry, Fort Collins, CO (US); Rachel Feeny, Fort Collins, CO (US); Alan B. Franklin, Fort Collins, CO (US); Cody Carrell, Fort Collins, CO (US)

(73) Assignees: Colorado State University Research Foundation, Fort Collins, CO (US); The United States of America, as represented by the Secretary of Agriculture, Fort Collins, CO (US)

( * ) Notice: Subject to any disclaimer, the term of this patent is extended or adjusted under 35 U.S.C. 154(b) by 193 days.

(21) Appl. No.: 16/530,638

(22) Filed: Aug. 2, 2019

(65) Prior Publication Data

US 2020/0038866 A1 Feb. 6, 2020

Related U.S. Application Data

(60) Provisional application No. 62/713,863, filed on Aug. 2, 2018.

(51) Int. Cl.
*B01L 3/00* (2006.01)

(52) U.S. Cl.
CPC . *B01L 3/502746* (2013.01); *B01L 2300/0874* (2013.01); *B01L 2300/0887* (2013.01);
(Continued)

(58) Field of Classification Search
CPC ..... B01L 3/502746; B01L 2400/0481; B01L 2300/0887; B01L 2300/126;
(Continued)

(56) References Cited

U.S. PATENT DOCUMENTS 3,249,514 A 5/1966 Eli
2007/0082376 A1 4/2007 Black et al.
(Continued)

FOREIGN PATENT DOCUMENTS

KR 20130000009 A * 1/2013
KR 20170115388 A * 10/2017
(Continued)

OTHER PUBLICATIONS

Bisha et al., "Colorimetric Paper-based Detection of *Escherichia coli, Salmonella* spp., and Listeria monocytogenes from Large Volumes of Agricultural Water," J Vis Exp., 88, pp. 1-7, Jun. 2014.
(Continued)

*Primary Examiner* — Matthew D Krcha
*Assistant Examiner* — Sophia Y Lyle
(74) *Attorney, Agent, or Firm* — Haukaas Fortius PLLC; Michael H. Haukaas

(57) ABSTRACT

A system for and methods of analyzing a test sample through the use of a rotary apparatus that includes a microfluidic paper-based apparatus (mPAD). The apparatus includes two or more layers that are rotatable with respect to one another. A middle layer may comprise a microfluidic apparatus having one or more reagent channels. Each of the reagent channels may include reagent dried on the surface of the channel, and, together with an absorption pad, may be aligned vertically with a sample chamber. Male and female engagement surfaces on each of the middle layer, the top layer, and the bottom layer interlock to secure each layers in vertical alignment so that fluid flows through the apparatus
(Continued)

to contact a test sample with a reagent and facilitate detection of a target analyte in the test sample in the sample chamber.

20 Claims, 13 Drawing Sheets

(52) U.S. Cl.
CPC . *B01L 2300/126* (2013.01); *B01L 2400/0481* (2013.01); *B01L 2400/088* (2013.01)

(58) Field of Classification Search
CPC ..... B01L 2300/0874; B01L 2400/088; B01L 3/502715; B01L 2400/043; B01L 3/502707; B01L 2300/161; B01L 2200/16
See application file for complete search history.

(56) References Cited

U.S. PATENT DOCUMENTS

| | | | | |
|---|---|---|---|---|
| 2007/0202538 | A1* | 8/2007 | Glezer | G01N 33/54366 435/7.1 |
| 2010/0120173 | A1* | 5/2010 | Zhou | B01L 3/5025 436/518 |
| 2011/0065127 | A1 | 3/2011 | Heller et al. | |
| 2012/0238008 | A1 | 9/2012 | Henry et al. | |
| 2015/0024426 | A1* | 1/2015 | De Oliveira Garcia Da Fonseca | G01N 15/05 435/29 |
| 2015/0247845 | A1* | 9/2015 | Heller | B82Y 15/00 506/9 |
| 2015/0359458 | A1 | 12/2015 | Erickson et al. | |
| 2016/0138076 | A1 | 5/2016 | Yang-Woytowitz et al. | |
| 2016/0169867 | A1* | 6/2016 | Khine | G01N 33/493 422/82.09 |
| 2017/0095814 | A1* | 4/2017 | Boehm | G01N 35/00 |
| 2018/0361382 | A1* | 12/2018 | Zobi | B04B 9/10 |
| 2019/0302097 | A1* | 10/2019 | Niu | G01N 35/10 |

FOREIGN PATENT DOCUMENTS

| | | | | |
|---|---|---|---|---|
| WO | 2007092909 | A2 | 8/2007 | |
| WO | 2008049083 | A2 | 4/2008 | |
| WO | WO-2016085632 | A2 * | 6/2016 | B01L 7/00 |
| WO | WO-2017210976 | A1 * | 12/2017 | G01N 33/48 |
| WO | WO-2017214323 | A1 * | 12/2017 | B04B 5/0407 |

OTHER PUBLICATIONS

Boehle et al., "Utilizing Paper-Based Devices for Antimicrobial-Resistant Bacteria Detection," Angew Chem Int Ed Engl., 56(24):6886-6890, Jun. 2017.
Card et al., "Evaluation of an Expanded Microarray for Detecting Antibiotic Resistance Genes in a Broad Range of Gram-Negative Bacterial Pathogens," Antimicrob Agents Chemother., 57(1):458-465, Jan. 2013.
Cate et al., "Multiplexed paper analytical device for quantification of metals using distance-based detection," Lab Chip, 15, May 2015, 2808-2818.
Cate et al., "Recent Developments in Paper-Based Microfluidic Devices," Anal Chem., 87(1):19-41, Jan. 2015.
Deiss et al., "Antimicrobial Susceptibility Assays in Paper-based Portable Culture Devices," Lab Chip, 14(1):167-171, Jan. 2014.
Jokerst et al., "Development of a Paper-Based Analytical Device for Colorimetric Detection of Select Foodborne Pathogens," Anal. Chem., 84(6):2900-2907, Feb. 2012.
Livermore et al., "Detection of β-lactamase-mediated Resistance," J Antimicrob Chemother., 48(Suppl 1):59-64, Jul. 2001.
Martinez et al., "Patterned Paper as a Platform for Inexpensive, Low Volume, Portable Bioassays," Angew. Chem. Int. Engl., 46(8), Feb. 2007, 7 pgs.
Martinez et al., "Patterned Paper as a Platform for Inexpensive, Low-Volume, Portable Bioassays," Angew Chem Int Ed Engl., 46(8):1318-1320, Feb. 2007.
O'Callaghan et al., "Novel Method for Detection of 3-Lactamases by Using a Chromogenic Cephalosporin Substrate," Antimicrob Agents Chemother., 1(4):283-288, Apr. 1972.
Srisa-Art et al., "Highly Sensitive Detection of *Salmonella typhimurium* Using a Colorimetric Paper-Based Analytical Device Coupled with Immunomagnetic Separation," Anal. Chem., 90, Jan. 2018, 1035-1043.
Abe et al., "Inkjet-Printed Microfluidic Multianalyte Chemical Sensing Paper," Anal. Chem., 80(18):6928-6934, Aug. 2008.
Boehle et al., "Single Board Computing System for Automated Colorimetric Analysis on Low-Cost Analytical Devices," Anal Mehods, 10(44):5282-5290, Oct. 2018.
Fenton et al., "Multiplex Lateral-Flow Test Strips Fabricated by Two-Dimensional Shaping," ACS Appl. Mater. Interfaces, 1(1):124-129, 2009.
Lu et al., "Rapid Prototyping of Paper-Based Microfluidics With Wax for Low-Cost, Portable Bioassay," Electrophoresis, 30(9):1497-500, May 2009.
Nie et al., "Electrochemical Sensing in Paper-Based Microfluidic Devices," Lab Chip, 10(4):477-483, Feb. 2010.
Xia et al., "Fabrication Techniques for Microfluidic Paper-Based Analytical Devices and Their Applications for Biological Testing: A Review," Biosens. Bioelectron., 77(15):774-789, Mar. 2016.

* cited by examiner

A

B

ROTARY MANIFOLD FOR PAPER-BASED IMMUNOASSAYS

RELATED APPLICATIONS

This application claims priority under 35 U.S.C. § 119(e) to U.S. Provisional Patent Application No. 62/713,863 filed Aug. 2, 2018, which is incorporated herein by reference.

GOVERNMENT SUPPORT

This invention was made with government support under cooperative agreements 15-7400-0859-CA, 16-7400-0859-CA, and 17-7400-0859-CA awarded by the United States Department of Agriculture, Animal and Plant Health Inspection Service. The government has certain rights in the invention.

FIELD OF THE INVENTION

This disclosure relates generally to chemical assay devices. More particularly, the invention provides for simple, low-cost, and rapid microfluidic paper-based diagnostic devices and methods of use of the same.

BACKGROUND

Point-of-care ("POC") diagnostic assays are an important tool in diagnosing a disease or condition, and also for monitoring the health of individuals within a population. Such POC diagnostic assays may be attractive in many resource-limited settings where healthcare, transportation, and distribution infrastructure may be underdeveloped and/or underfunded. POC diagnostic assays may provide a user with the ability to diagnose diseases without the need for the support of a laboratory infrastructure which, consequently, increases access to diagnostic testing, eliminates the need for sample transport, and reduces diagnostic turnaround times from weeks or month to, in some cases, mere hours. As a result of the use of POC diagnostic assays, more patients are effectively diagnosed, which, in turn, enables a faster and a more complete treatment.

One effective POC diagnostic assay includes the use of Microfluidic Paper-based Devices, or "mPADs". Advantageously, mPADs are small, portable and easily fabricated from inexpensive materials that may be delivered to remote, resource-limited locations. For example, mPADs may be fabricated easily by printing patterns onto paper with a solid ink (wax) printer and melting the ink to create hydrophobic barriers spanning through the entire thickness of the paper substrate. The mPADs may use the paper as a fluidic substrate and utilize the wicking/capillary properties of the paper to transport a biological sample and/or reagent to a sample testing region of the apparatus where the diagnostic reaction occurs. Additionally, the paper substrate may be biocompatible, functionalized for more complex chemistry, and, after use, safely disposed by burning in resource-limited settings.

Despite these advantages in diagnostic testing, the use of mPADs is not without issues. For example, mPADs are often less sensitive and report poorer limits of detection than assays originally designed as in-solution or microfluidic assays. Furthermore, the flow rates of both samples and reagents in paper substrates are difficult to control, and, typically, are slower than flow rates achieved using external pumps. Consequently, diagnostic testing may take several hours or more to complete. Additionally, the stability—that is, the shelf life—of reagents absorbed on the paper substrate may be inadequate for commercialization of paper-based devices in resource-limited settings.

Moreover, many diagnostic assays also require sequential and timed reagent delivery that may be difficult to accomplish using traditional mPADs. Therefore, there is significant current interest in the development of sequential injection mPADs and other flow control tools. One common approach to control flow rates in paper substrates in mPAD assays includes the use of complex folding or origami devices to create 3D channels in the paper substrate. Unfortunately, these origami mPADs suffer from a lack of consistency in folding that results in poor reproducibility.

Accordingly, there is a need for an apparatus that is of easily reproduceable construction and includes an increased sensitivity of detection of a target analyte. The present invention satisfies these needs.

SUMMARY OF THE INVENTION

The invention provides for a system that includes the use of a rotary microfluidic paper-based apparatus and methods of use. The apparatus generally includes a housing comprising one or more layers, a sample chamber, an mPAD, and a fluid reservoir that permits the sequential delivery of various reagents to the sample chamber for detection of an analyte in a test sample positioned within a test area of the sample chamber.

Certain preferred embodiments of the invention include a housing having a top layer, a middle layer, a bottom layer, and a central vertical rotational axis. Each of the top layer, the middle layer, and bottom layer may be substantially disk or disk-like and oriented perpendicular to the central vertical rotational axis.

The housing may be constructed of any plastic or polymer material. Preferably, the housing may be constructed using three-dimensional printing techniques. Each of the layers may be removably connected to one another and at least the middle layer—that is, the microfluidic layer—is rotatable relative to at least the bottom layer containing the sample chamber, and more preferably, rotatable relative to both the top and bottom layers. In certain embodiments of the invention, each of the layers may be rotatable about the central vertical rotational axis relative to one another.

The support layer or top layer may provide a cover for the housing that also may include connection points that function as a means for interconnecting the various layers to form the complete housing. The top cover—when connected to, for example, a bottom layer as described herein—also may provide pressure to the microfluid layer to facilitate the flow of fluid through the apparatus.

In preferred embodiments, the middle layer includes a removable microfluidic layer or mPAD. The term "mPAD" and "reagent card" are used interchangeably. The removable mPAD may comprise one or more of a paper membrane, transparency sheets, lamination sheets, or a combination thereof to provide a paper-based substrate into which a plurality of reagent channels and a plurality of absorption pads are cut or etched. Preferably, the reagent channels and absorption pads are arranged radially about the central vertical rotational axis. Preferably, an absorption pad is stacked above a portion of a reagent channel. One or more of the reagent channels may include a reagent useful for diagnostic testing. The reagents are preferably dried onto the surface of the reagent channels.

The bottom layer may comprise a fluid reservoir and a removable sample chamber for receiving a test sample. The sample chamber also may include one or more magnets for use in various magnet based diagnostic assays.

The construction of the housing may allow the middle layer to rotate about the central vertical axis in relation to the top and bottom layers. This rotational movement may permit the user to align vertically a reagent channel and absorption pad with the sample chamber so that the reagent channel, absorption pad, fluid reservoir, and the sample chamber are in fluid communication with one another. The vertical alignment permits a fluid to flow from the fluid reservoir and wicking channel through the reagent channel to the sample chamber—picking up any reagent disposed within the reagent channel in the process—to contact the reagent with the test sample in the sample chamber in order to detect one or more analytes of interest in the test sample. An absorption pad in fluid communication with the sample chamber and testing area receives the fluid from the sample chamber and facilitates the flow of fluid from the buffer reservoir to the absorption pad through wicking and/or capillary action.

In certain embodiments of the invention, each of the layers may include complementary male and female engagement surfaces or similar structures that function to secure the reagent channels and the sample chamber in vertical alignment. The engagement surfaces may be positioned to permit a defined amount of rotation of the layers in order to lock in place and align the reagent channel and absorbent pads with the sample chamber. For example, the engagement surfaces may be sized, shaped, and positioned to disengage from a locked position, permit about 45 degrees of rotation of the middle layer relative to the top and bottom layer before the engagement surfaces re-engage and interlock the layers into a new position. This may be repeated as necessary until all the reagents are delivered to the sample chamber.

Certain preferred embodiments include the use of metal affinity assay components. For example, the sample chamber may include the use of magnetic beads or the like disposed on the surface of the sample chamber or testing area. The magnetic beads may be at least partially coated with a capture molecule such as an antibody, an antigen, an aptamer, or polynucleotide to contact and capture an analyte in the test sample. The reagents in the reagent channels which contact the test sample may be selected to facilitate the metal affinity assay.

Advantageously, embodiments of the invention permit the use of customizable absorbent pads to control fluid flow though the apparatus.

Advantageously, embodiments of the invention include a disposable mPAD and a low cost, portable, and reusable housing that may be printed using a three-dimensional printing apparatus and widely available software.

Advantageously, embodiments of the invention provide for improved consistency of vertical alignment of a reagent channel with the sample chamber through the use of the male and female engagement surface that lock the layers into position.

Advantageously, embodiments of the invention provide for the use of reagent channels to sequentially deliver various reagents and wash buffers to the test sample.

Advantageously, embodiments of the invention allow for easy swapping of capture molecules for detection of different analytes.

The disclosure provides for other aspects and embodiments that will be apparent in view of the following detailed description and accompanying figures.

BRIEF DESCRIPTION OF THE DRAWINGS

The preferred embodiments of the invention will be described in conjunction with the appended drawings provided to illustrate and not to the limit the invention, where like designations denote like elements, and in which.

Fluorescent intensity of sample layer before and after 4 washes in the apparatus. (B.) Summed fluorescent intensities of the reagent layer and waste pads used for washing.

DETAILED DESCRIPTION

The present invention generally is directed to a system and methods for detecting analytes in a test sample using a rotary paper-based microfluidic apparatus. Certain preferred embodiments of an apparatus of the invention may be used for the sequential delivery of reagents to a test sample to facilitate diagnostic testing.

Figure 1:
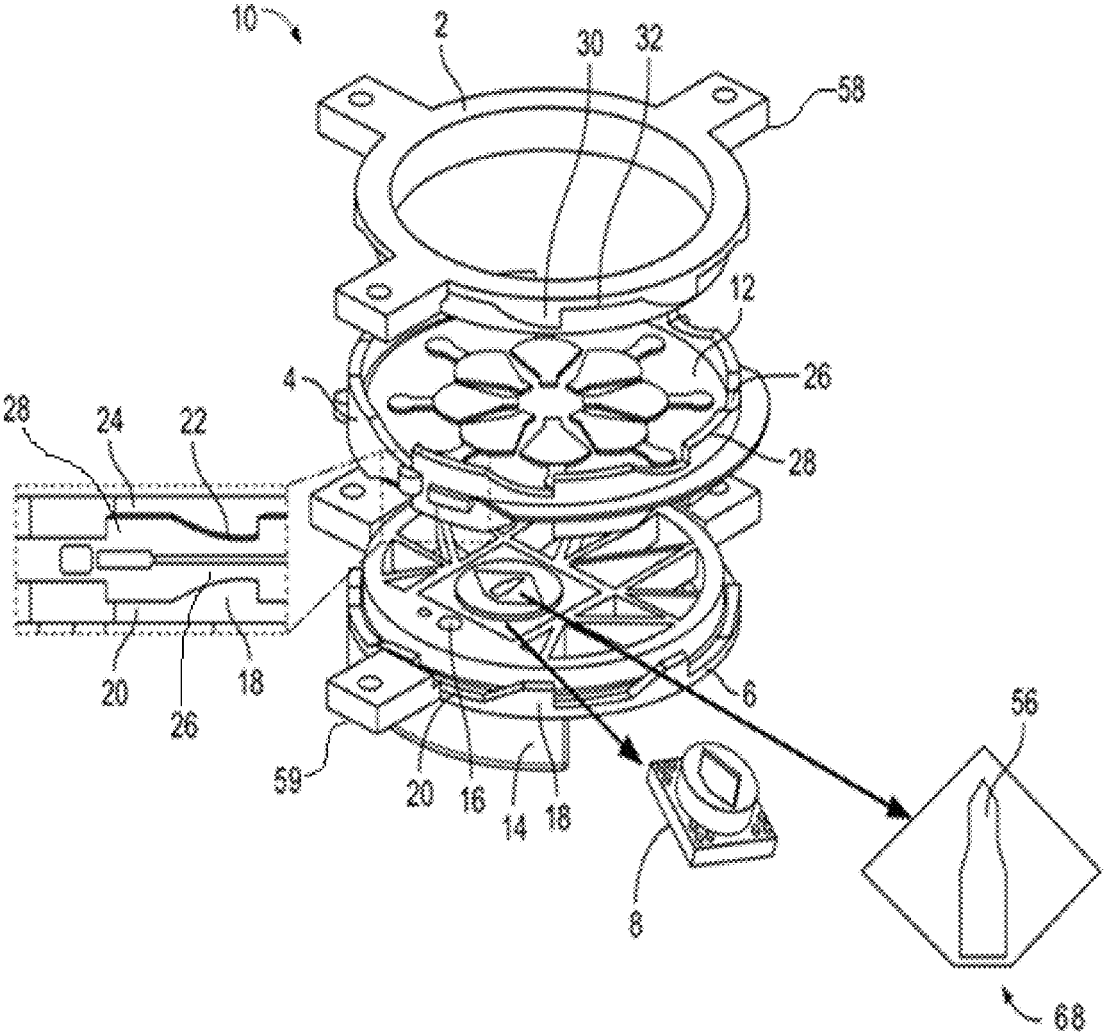
FIG. 1 illustrates an exploded view of one embodiment an apparatus of the invention; the inset shows all three layers of the assembled apparatus locked in alignment.
Figure 2:
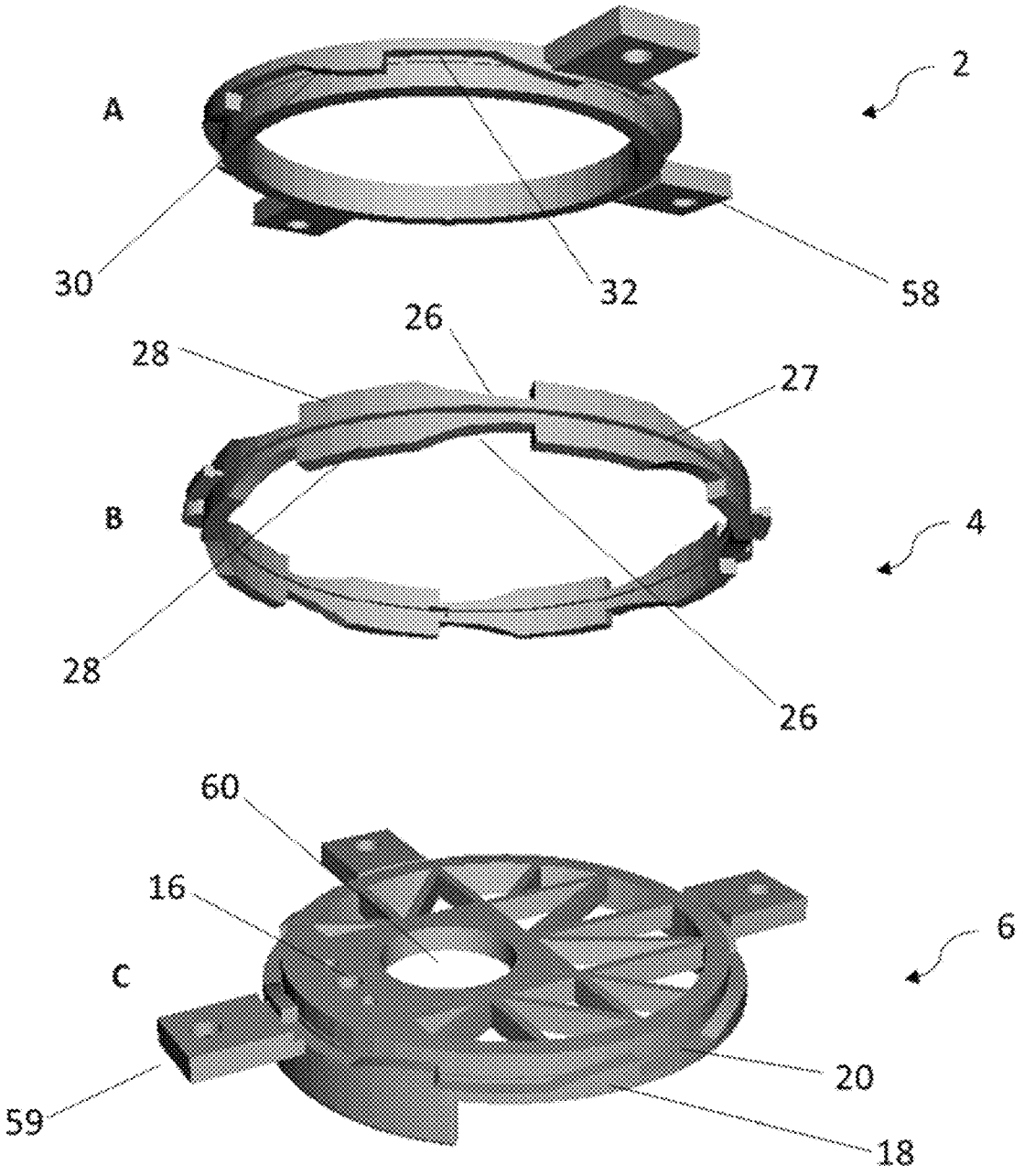
FIG. 2 illustrates a perspective view of an embodiment of (A.) a top layer of the apparatus, (B.) a middle layer of the apparatus, having tabs on the outer surface of the layer to aid manual rotation of the middle layer by a user, and (C.) a bottom layer of the apparatus.

FIG. 1 and FIG. 2 illustrate one preferred embodiment of a system according to the present invention comprising an apparatus 10 that may include a multilayered housing. Preferably, the multilayered housing includes a least three layers: a top or support layer 2, a middle or microfluidic layer 4, and a bottom or sample layer 6. Each layer may be of any shape, but preferably, each layer is generally disk-shaped or annular. As is described in more detail below, the apparatus may be constructed such that each of the layers may be rotated with respect to one another about a central vertical rotational axis and, after rotation, each of the layers may be locked in place and secured through the use of a locking mechanism. While the description focuses on one embodiment of an apparatus having three layers, it is contemplated that two of the layers may be combinable into a single layer. For example, the top and middle layers may be combined to form a single layer. Alternatively, an apparatus may include three or more layers.

The top or support layer 2 may include one or more integral connection points 58 disposed about an outside edge of the top layer 2. The connection points 58 may be configured to attach to complementary attachment points 59 in the bottom layer 6 through the use of a fastener such as a bolt, screw, nut, buckle or the like. In some embodiments, the top layer 2 may be attached and secured to the bottom layer 6 through the use of one or more spring-loaded bolt or screw that may allow rotation of a layer (e.g., middle layer) of the housing after pressure is applied to pull the top and bottom layers apart, and, after rotation, maintains pressure on the individual layers of the apparatus once the layers are secured in vertical alignment.

The top layer 2 may include also one or more integral male and female engagement surfaces 30, 32 (i.e., peaks and troughs) that engage complementary male and female (peaks and troughs) engagement surfaces 26, 28 of the middle layer 6. The engagement surfaces may be positioned at certain intervals in order to permit rotation of a layer over a defined distance with respect to another layer. For example, the engagement surfaces may be sized and shaped to engage corresponding engagement surfaces to permit rotation of a layer in increments of about 10 degrees, about 20 degrees, degrees, about 30 degrees, about 40 degrees, about 50 degrees, about 60 degrees, 70 degrees, about 80 degrees, about 90 degrees, about 100 degrees, about 110 degrees, about 120 degrees, about 130 degrees, about 140 degrees, about 150 degrees, about 160 degrees, about 170 degrees, or about 180 degrees in a single turn of a layer of the apparatus. Once an engagement surface has traveled the predetermined distance, the surfaces may interlock with an engagement surface from a different layer (e.g., top layer and/or bottom layer) of the apparatus 10 to lock or secure each layers in position.

The middle layer 4 may include both an upper row of male and female engagement surfaces 26, 28 and a lower row of male and female engagement surfaces 22, 24 to simultaneously engage the corresponding engagement surfaces in the top 2 and bottom layers 6, respectively. The middle layer 4 may be configured to receive an mPAD 12. The mPAD 12 may be inserted into the apparatus 10 by removing one or more of the layers from the housing 1 and then placing the mPAD 12 directly into the apparatus 10. In alternate embodiments, the mPAD 12 may be inserted into the apparatus through a slot or opening 27 in the middle layer 4. Preferably, the mPAD 12 is disposable and replaceable with various other mPADs that may be inserted into the apparatus 10 depending on the assays used to detect an analyte in the test sample or to analyze a different test sample using the same or different diagnostic assay. The middle layer 4 also may include one or more tabs or protrusions disposed about the outside surface of the middle layer 4 for use as a gripping surface to facilitate manual rotation of the layer.

The bottom layer 6 may include one or more connection points 59 disposed about an edge of the bottom layer 6 to connect the bottom layer 6 to the top layer 2 and secure the apparatus 10 together. The securement of the apparatus 10 may be accomplished through the use of a fasting mechanism as described previous. The bottom layer 6 may include a row of engagement surfaces 18, 20 that may interlock with complimentary engagement surfaces on the middle layer 4 to facilitate vertical alignment of the reagent channels 45 and sample chamber 8. The inset of FIG. 1 illustrates the top layer 2, the middle layer 4, and the bottom layer 6 of the fully assembled apparatus locked into position through the interaction of engagement surfaces 18, 20 of the bottom layer, 26, 28 of the middle layer, and 30, 32 of the top layer.

Additionally, the bottom layer 6 may include also a fluid reservoir 14 and a removable sample chamber 8. The fluid reservoir 14 may be removable from or integral to the bottom layer 6. The fluid reservoir 14 may be a chamber that is fillable with a fluid selected for use with a particular diagnostic assay. The fluid reservoir may be fluidly connected to the mPAD 12, the sample chamber 8, or both. A wicking channel 16 may be disposed between the fluid reservoir 14 and a reagent channel in the mPAD 12 to facilitate fluid flow through the apparatus.

The sample chamber 8 may be removable from the bottom layer 6 through a sample chamber receiving area 60. The sample chamber 8 may comprise a sample chamber surface 68 that may include one or more testing areas 56. A testing area 56 may include a paper substrate as described herein that permits fluid flow throughout the apparatus 10. The testing area 56 may comprise a capture molecule disposed on its surface. In one certain embodiment, the testing area 56 includes a plurality of magnetic beads (e.g., Dynabeads™ magnetic particles) disposed on the surface of the testing area 56. In assays that use magnetic beads or other mechanisms of magnetic separation of an analyte from a test sample, one or more magnets may be disposed within the sample chamber 8 beneath the testing area 56. Preferably, the magnets may be separable from the sample chamber 8 to facilitate magnetic separation.

In alternate embodiments of the invention, the top or bottom layers 2, 6 may include one or more ports or openings that may be used to attach various components such as, for example, a buffer vial, magnet holder, or absorbent pad holder. Preferably, the ports or openings and the components include complementary threads for attachment or, alternatively, the components may be fitted to the apparatus through friction fitting.

In preferred embodiments of the invention, the housing may be three-dimensionally printed from a material comprising any one of a resin, acrylonitrile butadiene styrene, thermoplastic elastomers, thermoplastic polyurethane, poly lactic acid, high impact polystyrene, polyethylene terephthalate, glycol modified polyethylene terephthalate, nylon, carbon fiber, acrylic styrene acrylonitrile, polycarbonate, polypropylene, poly vinyl acetate, or a combination thereof.

Alternatively, the housing may be constructed using traditional plastic molding techniques that are well-known in the art.

Figure 3:
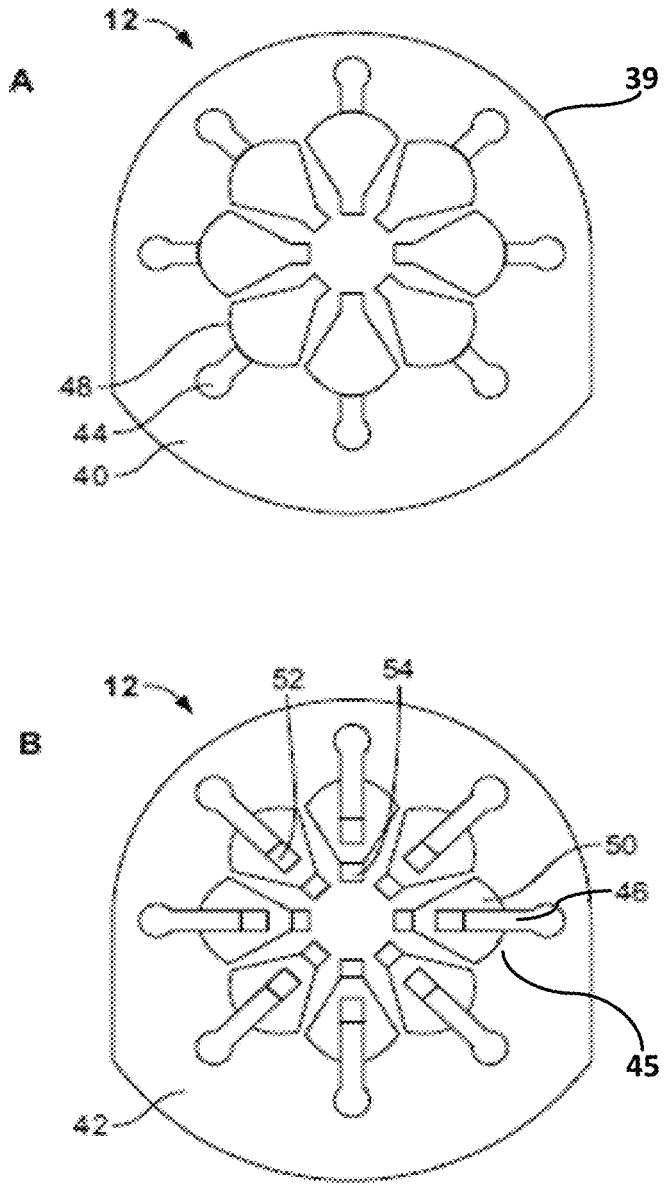
FIG. 3 illustrates views of one embodiment of an mPAD; (A.) A top view of one certain preferred embodiment of an mPAD. (B.) A bottom view of the mPAD shown in (A)
Figure 4:
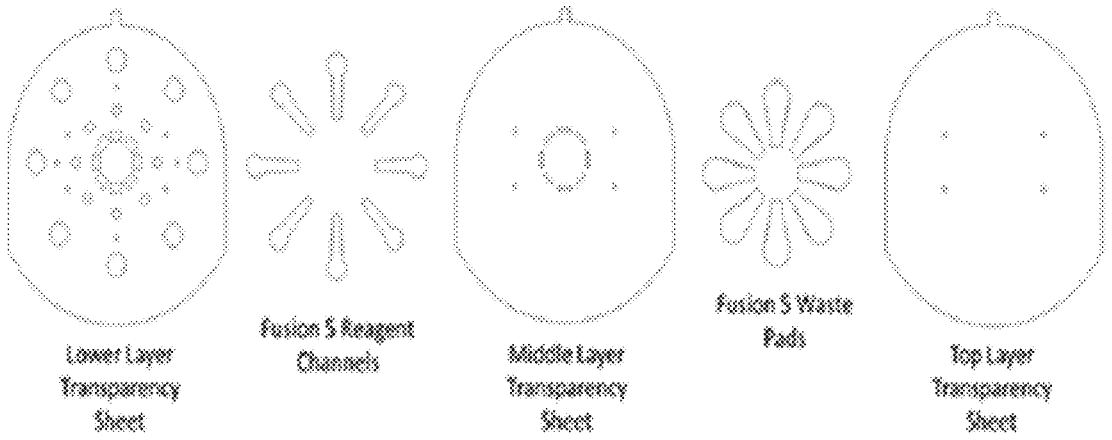
FIG. 4 illustrates one embodiment of the different layers of transparency and paper pieces that make up the reagent card (A.) and their stacking orientation before lamination (B.). The lower transparency sheet is coated with a hydrophobic coating such as, for example, NeverWet from Rust-Oleum.
Figure 4:
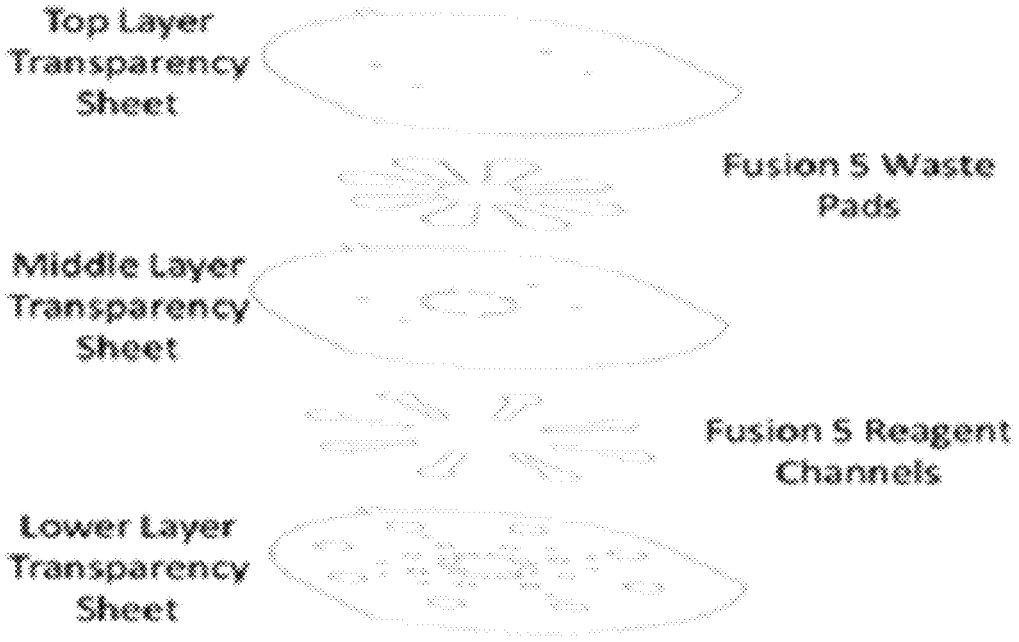

FIG. 3 and FIG. 4 illustrate one certain embodiment of an mPAD 12 that may be used with the apparatus 10. The mPAD 12 includes a substantially planar paper substrate 39 having a top surface 40, a bottom surface 42, and a space therebetween into which a plurality of reagent channels 45 and absorbent pad holders (not shown) configured to hold absorbent pads 50 may be cut or etched into the paper substrate 39. In one preferred embodiment of the invention, the mPAD may comprise a plurality of reagent channels 45 and a plurality of absorbent pads 50 positioned within the paper substrate distributed radially about a central vertical rotational axis of the apparatus. The reagent channel 45 and absorbent pad 50 may be present in a 1:1 ratio, that is, one absorbent pad 50 is present for each reagent channel 45. It is contemplated that at least a portion of each of the reagent channels 45 may be fluidly connected to the buffer reservoir 14 and at least a second portion of each of the reagent channels 45 in fluid communication with the sample chamber 8 and testing area 56.

Exemplary reagent channels 45 of an mPAD 12 may include a channel head or reservoir 44 and a channel body 46. The size of the channel head 44 may be appropriately set according to a desired fluid volume, sample size, and the number of other reagent channels 45 in the paper substrate 39. The diameter of the channel head 44 may be about 1 mm to 10 mm, or about 3 mm to 10 mm, or more preferably about 5 mm to 10 mm. In some embodiments, each reagent channel 45 may include a plurality of channel heads 44, for example, about 2-4 channel heads, about 2-6 channel heads, about 2-8 channel heads, or about 2-10 channel heads. Each of the aforementioned channel heads 44 may be connected to the reagent channel 45 as required.

Preferably, the paper substrate 39 of the mPAD 12 is constructed of, for example, a paper membrane, filter paper, parchment paper, wax paper, Palette paper, Whatman paper, transparency sheets, lamination sheets, chromatography paper, tape, polystyrene, polyethylene, polyvinylchloride, thin film photoresist, polyimide, glues, epoxies, wax, PDMS, silicone, latex, or any other suitable polymers, metals, or any combination thereof. The paper substrate 39 may also be a laminate material of one or more of these materials. Certain preferred embodiments include a paper substrate 39 constructed of a laminate of one or more of a paper membrane, transparency sheets, or lamination sheets. In other embodiments of the invention, the paper is a single paper membrane such as the commercially available Fusion 5 Paper™. The reagent channels also may include a hydrophobic surface and/or barrier to facilitate fluid flow through the apparatus. Such hydrophobic material may include, for example, a wax or the commercially available product NeverWet™ wax made by Rustoleum®. Exemplary methods for patterning reagent channels and the like are described in WO2008/049083, and Abe et al., *Inkjet-printed microfluidic multianalyte chemical sensing paper. Anal. Chem.* 2008, 80, 6928-6934; Fenton et al., *Multiplex Lateral-Flow Test Strips Fabricated by Two-Dimensional Shaping, ACS Appl. Mater. Interfaces* 2008, 1, 124-129; Nie et al., *Electrochemical sensing in paper-based microfluidic devices, Lab Chip* 2010, 10, 477-483; and Lu et al., *Rapid prototyping of paper-based microfluidics with wax for low-cost, portable bioassay, Electrophoresis* 2009, 30, 1497-1500.

The paper substrate may be constructed using known techniques such as wax printing, inkjet printing, photolithography, flexographic printing, plasma treatment, laser treatment, wet etching, screen-printing, and wax screen-printing as described, for example, in Xia et al., *Fabrication techniques for microfluidic paper-based analytical devices and their applications for biological testing: A review*, Biosens Bioelectron. 2016 Mar. 15; 77:774-89.

The absorbent pads 50 may be constructed of any absorbent material such as filter paper or Whatman paper. The absorbent pads 50 may be disposed above or below a reagent channel 45 within the paper substrate 39 and separated from the reagent channel 45 by a barrier (e.g., a lamination sheet layer or other hydrophobic surface) to prevent the direct flow of fluid between the reagent channel 45 and the absorbent pad 50. Preferably, the absorbent pads 50 are disposed above at least a portion of a reagent channel 45. At least a portion of the absorbent pads 50 may overlap or otherwise be in fluid communication with the sample chamber 8 and testing area 56.

Figure 5:
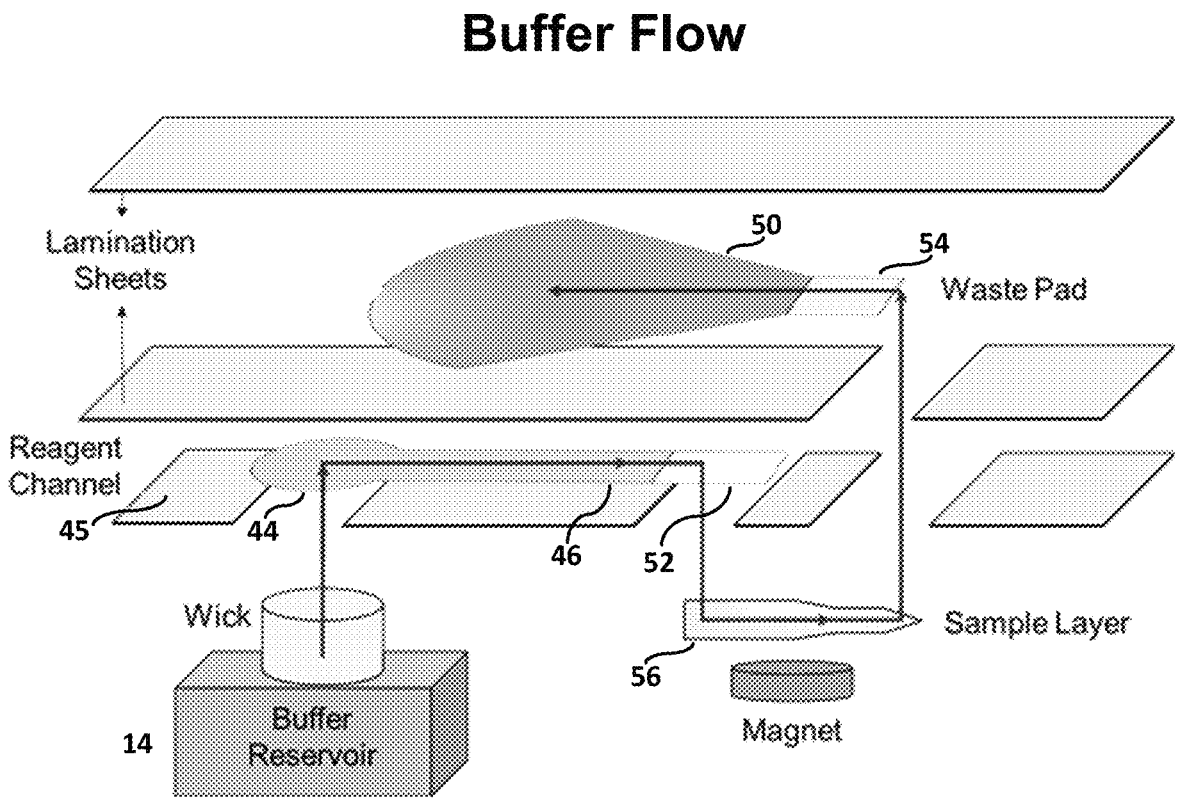
FIG. 5 illustrates buffer flow through one embodiment of an apparatus upon vertical alignment of a reagent channel and the sample chamber.

FIG. 1, FIG. 3, and FIG. 5 illustrate the fluid flow though the apparatus upon vertical alignment of a reagent channel 45 with the sample chamber 8 for testing. The vertical alignment of the components of the apparatus permits fluid from the fluid reservoir 14 to flow into the channel head 44 and pass into the channel body 46, thereby solvating any dried reagent disposed on the surface of the reagent channel 45. Further movement of the fluid causes the fluid to pass from the end or dispensing area 52—which overlaps and/or is in fluid communication with a portion of the sample layer—of the reagent channel 45 where the reagents react with a test sample or capture molecule disposed on the surface of the testing area 56. The fluid continues to pass through the test area 56 and enters the absorbent pad 50 through an absorbing area 54 that also overlaps and/or is otherwise in fluid communication with a portion of the test area 56. Once it is determined that the reagent has interacted with the test sample, the middle layer 4 of the apparatus 10 may be rotated, and the next reagent channel 45 brought into vertical alignment with the sample chamber 8 and the process is repeated to contact the sample with another reagent, for example, a wash buffer.

Generally, any reagents useful in detecting one or more analytes in a sample may be disposed on the surface of a reagent channel. Preferably, the one or more reagents may be dried or adsorbed onto one or more of the reagent channels. Any reagent needed in the assay may be provided within a reagent channel in fluid communication with the sample chamber containing the test sample. Exemplary assay reagents include protein assay reagents, immunoassay reagents (e.g., ELISA reagents), glucose assay reagents, sodium acetoacetate assay reagents, sodium nitrite assay reagents, blocking agents, enzyme substrates, specific detection molecules such as an antibody, streptavidin-biotin conjugates (e.g., biotinylated anti-salmonella antibody, streptavidin β-galactosidase) polynucleotides, buffers such as phosphate buffered saline, aptamers, molecularly-imprinted polymers, chemical receptors, proteins, peptides, ligands, inorganic compounds, organic small molecules, haptens, chlorophenyl red galactopyranoside, or combinations thereof disposed within or in flow communication with one or more regions of the reagent channels.

A detection molecule (e.g., an antibody) may be "labeled" or include a "reporter" moiety. "Reporter," "reporter group,"

"label," and "detectable label" are used interchangeably herein. A reporter is capable of producing a signal that is detectable by visual or instrumental means. A variety of reporter groups may be used, differing in the physical nature of signal transduction (e.g., fluorescence, electrochemical, nuclear magnetic resonance (NMR), and electron paramagnetic resonance (EPR)) and in the chemical nature of the reporter group. Various reporters include signal-producing substances, such as chromagens, fluorescent compounds, chemiluminescent compounds, radioactive compounds, and the like. Reporters may include moieties that produce light, e.g., acridinium compounds, and moieties that produce fluorescence, e.g., fluorescein. In certain embodiments, the signal from the reporter is a fluorescent signal from a fluorophore. Exemplary fluorophores include, but are not limited to, acrylodan (6-acryloy 1-2-dimethylaminonaphthalene), badan (6-bromo-acetyl-2-dimethylam ino-naphthalene), rhodamine, naphthalene, danzyl aziridine, 4-[N-[(2-iodoacetoxy)ethyl]-N-methylamino]-7-nitrobenz-2-oxa-1,3-diazole ester (IANBDE), 4-[N-[(2-iodoacetoxy)ethyl]-N-N-methylamino-7-nitrobenz-2-oxa-1,3-diazole (IANBDA), fluorescein, dipyrromethene-boron difluoride (BODIPY), 4-nitrobenzo[c][1,2,5]oxadiazole (NBD), Alexa fluorescent dyes, and derivatives thereof. Fluorescein derivatives may include, for example, 5-fluorescein, 6-carboxyfluorescein, 3',6-carboxyfluorescein, 5(6)-carboxyfluorescein, 6-hexachlorofluorescein, 6-tetrachlorofluorescein, fluorescein, and isothiocyanate. When an enzyme is used as a reporter, e.g., alkaline phosphatase, horseradish peroxidase, luciferase, or β-galactosidase, an enzyme substrate may be disposed in the apparatus within or in flow communication with one of the regions of the reagent channel. Exemplary substrates for these enzymes include BCIP/NBT, 3,3',5,5'-Tetramethylbenzidine (TMB), 3,3'-Diaminobenzidine (DAB), and 2,2'-azino-bis(3-ethylbenzthiazoline-6-sulphonic acid) (ABTS), siloxane 3-aminopropyltriethoxysilane (APTMS), chlorophenyl red galactopyranoside, 4-methylumbelliferphosphoric acid, 3-(4-hydroxyphenyl)-propionic acid, or 4-methylumbellifer-β-D-galactoside, or the like.

In some embodiments of the invention, an apparatus may include many reagents, each of which may react with a different analyte to produce a detectable effect or signal. Alternatively, detection reagents may be sensitive to a predetermined concentration of a single analyte.

In some embodiments of the invention, the reagent may include a washing buffer, or plurality of washing reagents such as buffers or surfactant solutions, within or in fluid communication with a region of the reagent channel. Washing reagent(s) or washing buffers may function to wash an analyte bound in the sample chamber by removing unbound species therein when the reagent channel and sample chamber are in fluid communication. Suitable washing buffers may comprise, for example, a phosphate buffered saline, detergent, surfactants, water, a salt, or any combination thereof. The composition of the washing reagent may vary in accordance with the requirements of the specific assay such as the capture reagent and indicator reagent used to determine the presence of a target analyte in a test sample, as well as the nature of the analyte itself.

As described herein, the sample chamber may comprise a testing area having a paper substrate that may include a single assay region or multiple assay regions for the detection of multiple analytes. The testing area may include fluid-impermeable barrier defining the boundary of the testing area in the sample chamber. In some embodiments of the invention, the sample chamber may include two or more testing areas.

In certain embodiments, analytes may be detected by direct or indirect detection methods that apply the principles of immunoassays (e.g., a sandwich or competitive immunoassay or ELISA).

In embodiments using immunoassay techniques to detect a specific analyte (e.g., a protein), an assay region of the sample chamber may be coated or partially coated with capture molecules, such as antibodies, ligands, receptors, or small molecules that selectively bind to or interact with the target analyte. For example, to detect a specific antigen in a sample, an assay area of the such as antibodies that selectively bind to or interact with that antigen. Alternatively, to detect the presence of a specific antibody in the test sample, an assay region may be coated with antigens that bind or interact with that antibody. For example, capture molecules such as small molecules and/or proteins (e.g., an antigen) may be disposed on the surface of the sample chamber using similar chemistry to that used to immobilize molecules on beads or glass slides or using similar chemistry to that for linking molecules to carbohydrates. In alternative embodiments, capture molecules may be applied and/or immobilized in an assay region by applying a solution containing the capture molecule to an assay region and allowing the solvent to evaporate. The capture molecule may be immobilized by physical absorption onto the porous substrate by other non-covalent interactions. In preferred embodiments, the capture molecule may be disposed on at least a portion of a magnetic bead. The magnetic bead may be attached to the paper substrate or held in place in the sample chamber by a magnet positioned (e.g., under the testing area) to interact with the beads.

Certain preferred embodiments include the use of an immuno-magnetic separation sandwich assay, such as is described, for example, in Srisa-Art M. et al., *Highly Sensitive Detection of Salmonella typhimurium Using a Colorimetric Paper-Based Analytical Apparatus Coupled with Immunomagnetic Separation*, Anal. Chem., 2018 90(1), 1035-1043.

Analysis or quantification of an analyte in a test sample may include an additional step of creating digital data, such as an image, of the sample chamber containing the test sample and analyzing the image. Alternatively, the digital data may be transmitting remotely for analysis to obtain diagnostic information of the test sample.

A "sample" or "test sample" as used herein can mean any sample in which the presence and/or level of an analyte may be detected or determined. Samples may include liquids, solutions, emulsions, or suspensions. Samples also may include any biological fluid or tissue, such as blood, whole blood, fractions of blood such as plasma and serum, muscle, interstitial fluid, sweat, saliva, urine, tears, synovial fluid, bone marrow, cerebrospinal fluid, nasal secretions, sputum, amniotic fluid, bronchoalveolar lavage fluid, gastric lavage, emesis, fecal matter, lung tissue, peripheral blood mononuclear cells, total white blood cells, lymph node cells, spleen cells, tonsil cells, cancer cells, tumor cells, bile, digestive fluid, skin, or combinations thereof. In some embodiments, the sample comprises an aliquot. In other embodiments, the sample comprises a biological fluid. Samples may be obtained by any means known in the art. The sample may be used directly as obtained from a patient or can be pretreated, such as by filtration, distillation, extraction, concentration, centrifugation, inactivation of interfering components, addition of reagents, and the like, to modify the character of the sample in some manner as discussed herein or otherwise as is known in the art.

In some embodiments, the sample may include a volume of fluid sample such as a drop of blood, e.g., from a finger prick, or a small sample of urine, e.g., from a newborn or a small animal. In other embodiments, the apparatus described herein can be used for assaying aqueous fluid samples such as industrial fluid or a water sample. An apparatus also may be adapted for assaying non-aqueous fluid samples for detecting, for example, environmental contamination.

Typically, a single drop of fluid sample may be sufficient to perform a diagnostic assay to provide a simple yes/no answer to determine the presence of an analyte, or a semi-quantitative measurement of the amount of analyte present in the sample (e.g., by performing a visual or digital comparison of the intensity of the assay to a calibrated color chart). Yet, it also may be desirable to obtain a quantitative measurement of an analyte in the test sample. Such a measurement may require a defined volume of test sample to be deposited in the apparatus. Thus, in some embodiments of the invention, a defined volume of test sample (or a volume that is sufficiently close to the defined volume to provide a reasonably accurate readout) may be obtained by patterning the sample chamber and/or testing area to include a sample well that accepts a defined volume of fluid. For example, in the case of a whole blood sample, the subject's finger may be pinpricked and then pressed against the sample well until full, thus providing a satisfactory approximation of the defined volume.

The assay reagents included in the disclosed devices may be selected to provide a visible indication of the presence of one or more analytes in the test sample. The source or nature of the analytes that may be detected using the disclosed apparatuses are not intended to be limiting. Exemplary analytes include, but are not limited to, toxins, organic compounds, proteins, peptides, microorganisms, bacteria, viruses, amino acids, nucleic acids, carbohydrates, hormones, steroids, vitamins, drugs, pollutants, pesticides, and metabolites of or, antibodies to, any of the above substances. Analytes may include also any antigenic substances, haptens, macromolecules, and combinations thereof. For example, immunoassays using the disclosed apparatuses may be adapted for antigens having known antibodies that specifically bind the antigen.

In exemplary embodiments, the disclosed apparatuses may be used to detect the presence or absence of one or more viral antigens, bacterial antigens, fungal antigens, parasite antigens, or other biomarkers.

Exemplary viral antigens may include those from, for example, Chikungunya virus, Hepatitis A, B, C, or E virus, Hantavirus, Human Immunodeficiency Virus (HIV), Herpes Simplex Virus, West Nile Virus, Ebola virus, Varicella Zoster virus, Avian Influenza Virus, SARS virus, Epstein Barr virus, rhinoviruses, Dengue virus, Zika virus, Rubella virus, Human Y-lymphotropic virus, and coxsackieviruses.

Exemplary bacterial antigens may include those from, for example, *Arthrobacter globiformis, Staphylococcus aureus, Eshrechia coli, Staphylococcus epidermis, Brucella abortus, Helicobacter pylori, Streptococcus bovis, Streptococcus pyogenes, Streptomyces avidinii, Streptococcus pneumoniae, Leptospira biflexa, Listeria monocytogenes, Mycobacterium tuberculosis, Mycobacterium leprae, Corynebacterium diphtheriae, Borrelia burgdorferi, Bacillus anthracis, Bacillus cereus, Clostridium botulinum, Clostridium difficile, Salmonella typhimurium, Vibrio chloerae, Haemophilus influenzae, Bordetella pertussis, Yersinia pestis, Yersina enterocolitica, Neisseria gonorrhoeae, Treponema pallidum, Mycoplasm* sp., *Legionella pneumophila, Rickettsia typhi, Pseudomonas aeruginosa, Camplobacter jejuni, Chlamydia trachomatis, Shigella dysenteriae*, and *Vibrio cholera.*

Exemplary fungal antigens may include those from, for example, *Histoplasma capsulatum, Tinea pedis, Tinea corporus, Tinea cruris, Tinea unguium, Cryptococcus neoformans, Cladosporium carionii, Coccidioides immitis, Candida* sp., *Aspergillus fumigatus*, and *Pneumocystis*

Exemplary parasite antigens may include those derived from, for example, *Schistosoma japonicum, Giardia lamblia, Leishmania* sp., *Trypanosoma* sp., *Trichomonas* sp., and *Plasmodium* sp.

In other embodiments, the assay reagents and/or capture molecules may react with one or more biomarkers such as a metabolic compound. Exemplary metabolic compounds include, for example, proteins, nucleic acids, polysaccharides, lipids, fatty acids, amino acids, nucleotides, nucleosides, monosaccharides and disaccharides. For example, the assay components may be selected to detect the presence of at least one of glucose, protein, fat, vascular endothelial growth factor, insulin-like growth factor 1, antibodies, and cytokines.

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

The term "contacting" refers to the act of touching, making contact, or of bringing to immediate or close proximity, including at the cellular or molecular level, for example, to bring about a physiological reaction, a chemical reaction, or a physical change, e.g., in a solution, in a reaction mixture, in vitro, or in vivo.

"Polynucleotide" as used herein may be single stranded or double stranded or can contain portions of both double stranded and single stranded sequence. The polynucleotide can be nucleic acid, natural or synthetic, DNA, genomic DNA, cDNA, RNA, or a hybrid, where the polynucleotide can contain combinations of deoxyribo- and ribo-nucleotides, and combinations of bases including uracil, adenine, thymine, cytosine, guanine, inosine, xanthine hypoxanthine, isocytosine, and isoguanine. Polynucleotides can be obtained by chemical synthesis methods or by recombinant methods.

"Antibody" as used herein includes monoclonal antibodies (e.g., full length or intact monoclonal antibodies), polyclonal antibodies, multivalent antibodies, multispecific antibodies (e.g., bispecific antibodies so long as they exhibit the desired biological activity) and may also include certain antibody fragments such as, for example, Fab fragment that are known in the art.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The term "about" as used herein as applied to one or more values of interest, refers to a value that is similar to a stated reference value. In certain aspects, the term "about" refers to a range of values that fall within 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

The following Examples are intended to illustrate the above invention and should not be construed as to narrow its scope. One skilled in the art will readily recognize that the Examples suggest many other ways in which the invention could be practiced. It should be understood that numerous variations and modifications may be made while remaining within the scope of the invention.

EXAMPLES

Materials and Methods. Rotational Manifold: An apparatus as described herein was printed using the Form 2 3D Printer from FormLabs with their Clear V2 resin. All 3D-printed parts were designed in OnShape, a cloud-based CAD software. Also see U.S. Pat. No. 6,164,850 to Speakman et al. The paper channels, absorption pads, and sample layers were made of Fusion 5 Paper™, a conjugate-release membrane from GE healthcare. The reagent layer and sample layer were made from Fusion 5 Paper™ pieces and overlapping layers of 3M transparency sheets and Fellowes® lamination sheets. The layers were sealed using a laminator at 360° F. The surfaces of the reagent and sample layers were coated in Never-Wet®, a hydrophobic spray-on product from Rustoleum®. All designs for the two layers and paper pieces were created in CorelDraw (FIGS. 3 and 4).

IMS Assay Reagents: The reagents used in the *Salmonella* assay include: Dynabeads™ M-280 Tosylactivated (Invitrogen, purchased from Thermo Fisher Scientific, Milwaukee, Wis.); Anti-*Salmonella typhimurium* 0-4 antibody (Abcam, Cambridge, Mass., ab8274); *Salmonella* antibody-biotin conjugate (Invitrogen); Streptavidin-β-galactosidase conjugate (Invitrogen); and Chlorophenol Red-β-D-galactopyranoside (Sigma Aldrich).

The bacterial strains used include *Salmonella enterica serovar Typhimurium* and *Escherichia Coli* DH5a. The cells were grown in a difco (*Salmonella*) and LB (*E. Coli*) media for 12 hours to a final concentration ~$10^8$ CFU/mL. After each growth the cell concentration was quantified by serial dilution and plating. The cells were spiked into and diluted in growth media or milk at the desired concentrations before running the assay with the manifold. The buffer used in the manifold was a 1× solution of phosphate buffered saline (PBS) at pH 7.4 diluted in Milli-Q water.

Assay Steps: One milliliter ("mL") of liquid sample was incubated with 5 microliters ("μL") of 5 mg/mL magnetic bead-*Salmonella* antibody conjugate for 15 min at room temperature in a microcentrifuge tube. After a washing step using an external DynaMag-2 (Thermo Fisher Scientific) magnet for IMS, the magnetic bead-antibody-*Salmonella* conjugate was reconstituted in 60 μL of PBS buffer. A 15 μL aliquot of the concentrated solution was placed on the sample layer and the remainder of the assay (enzyme labeling and detection) performed in the rotational manifold.

Apparatus Operation: The manifold consists of four 3D printed pieces: the manifold top, center, and bottom, and the sample layer insert (FIG. 1 and FIG. 2). The top, center, and bottom pieces are all held together by bolts and springs. The springs allow the center piece to rotate while the top and bottom pieces are held in place. The center piece contains a slot for the reagent card (i.e., m PAD). Within the reagent card are eight reagent channels and waste pads. The reagent card may be made of five layers: a transparency sheet with a hydrophobic coating, the paper reagent channels, a 3 mil lamination sheet, the paper waste pads, and a 10 mil lamination sheet. The waste pads and sample layers are stacked on top of each other but are separated by the 3 mil lamination sheet. Four reagent channels store reagents and four are empty channels used for washing. Typically, two reagent channels and two washing channels are used to perform the assay and eight total channels permits the user to perform two separate tests with one reagent card. For example, in a four channel assay, the first channel contains 0.4 micrograms ("μg") of biotin-labeled *Salmonella* antibody that is deposited and dried prior to the assay; the second channel is empty for washing; the third channel contains 0.2 μg of dried Streptavidin β-galactosidase; and the fourth channel is empty. 5 μL aliquots of 40 μg/mL and 80 μg/mL Streptavidin β-galactosidase and biotin-ab are added to the reagent channels to obtain 0.2 μg and 0.4 μg of dried reagent, respectively.

When the manifold is assembled, the reagent card rotates with the middle layer. As the middle layer rotates, the top and bottom layers move vertically while keeping pressure on the center piece. After, for example, a 45° rotation, the middle layer clicks back into a slot configured to receive the reagent card and the top and bottom layers collapse down upon aligning the locking/engagement surfaces of each layer.

With each rotation, an opening in the reagent layer is aligned with a wick in the bottom layer of the manifold. The wick sits in a buffer reservoir, and when aligned with a hole in the reagent layer, permits the flow of fluid (e.g. a buffer) through the reagent channel, through sample layer, and into a waste pad. The fluid flow through the system delivers either a reagent to the sample layer or simply washes excess reagent away from the sample layer. The end-user may rotate the manifold after the waste pad is saturated (~2 min).

Colorimetric Detection: The final step of the assay may include the addition of a colorimetric substrate Chlorophenol red-β-D-galactopyranoside (CPRG) to the sample layer. In the presence of β-galactosidase, and therefore *Salmonella*, CPRG (Yellow color) will be turned over to CPR (Red color). The CPR can be monitored via image capture and analysis. The image of the colored sample layer may be taken inside a light box. An exemplary light box consists of two shells. The inner shell houses the sample layer and may be made of clear acrylic. The acrylic was sanded until cloudy to diffuse light and prevent glare on the sample. The outer shell covers the first and is made of black acrylic so no ambient light can reach the sample layer. The outer shell contains 35 white and warm white LEDs built into the walls and powered by a 9V battery. The inner and outer shells contain an opening for a smartphone to capture an image. It is contemplated that other chromogenic or visual detection methods may be used.

The resultant chemical signal may be captured using known image capturing devices (e.g., CCD cameras) to acquire static images of the sample layer at different time points. The captured images may be processed using, for example, NIH ImageJ or a flood-fill algorithm that demarcates the sample region from the surrounding template and analyzes each sample for color change. The Flood-fill is an example of a region segmentation algorithm. (Boehle et al., *Single board computing system for automated colorimetric analysis on low-cost analytical devices. Analytical Methods* 2018, 10 (44), 5282-5290). As used here, flood-fill finds a single contiguous region of pixels grown out from a seed pixel known to be in our sample. This is typically the center pixel in the image. Flood-fill starts with the seed and then recursively adds adjacent pixels to the region until no similar adjacent pixels are left to include. Because there is a distinct border around the color sample, at which the addition of pixels stops, the resulting region nicely contains the pixels from the sample and does not include extraneous pixels of the border or from elsewhere in the image. The precise settings used for flood-fill are captured in the following example the algorithm:

```
cv2.floodFill(image,mask,seed,(255,0,0),(4,4,4),(4,4,
    4),floodflags)
```

The above line of the floodFill function call takes the following inputs:

1. RGB image of the sample layer.
2. Mask is a pixel padding added to the four sides of the image.
3. Seed represents the starting point of the floodfill algorithm.
4. The fourth parameter represents the color by which the flood-filled region needs to be repainted.
5. The next two parameters represent the lower and upper color difference between the current pixel and its neighboring pixel. As we are dealing with RGB space, so we have 3 values representing threshold for each of the color space.
6. The final parameter defines the connectivity value that is the number of pixels to be considered around the current pixel.

Figure 10:
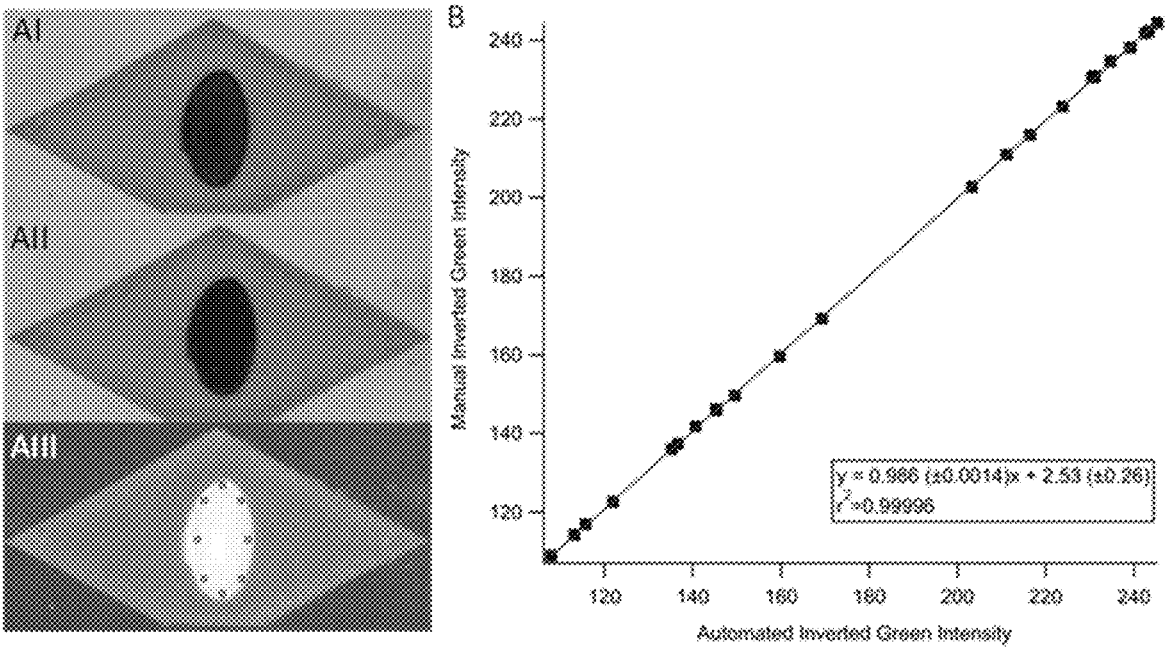
FIG. 10. illustrates an original image (AI), area of original image analyzed by flood fill algorithm (AII), manual analysis of one-color channel. (AIII) demonstrates the manual analysis using ImagJ software. Here a boundary was drawn by hand and all pixels within that boundary were analyzed. Inverted intensity found using a manual analysis vs the inverted intensity found with the automated algorithm.
Figure 11:
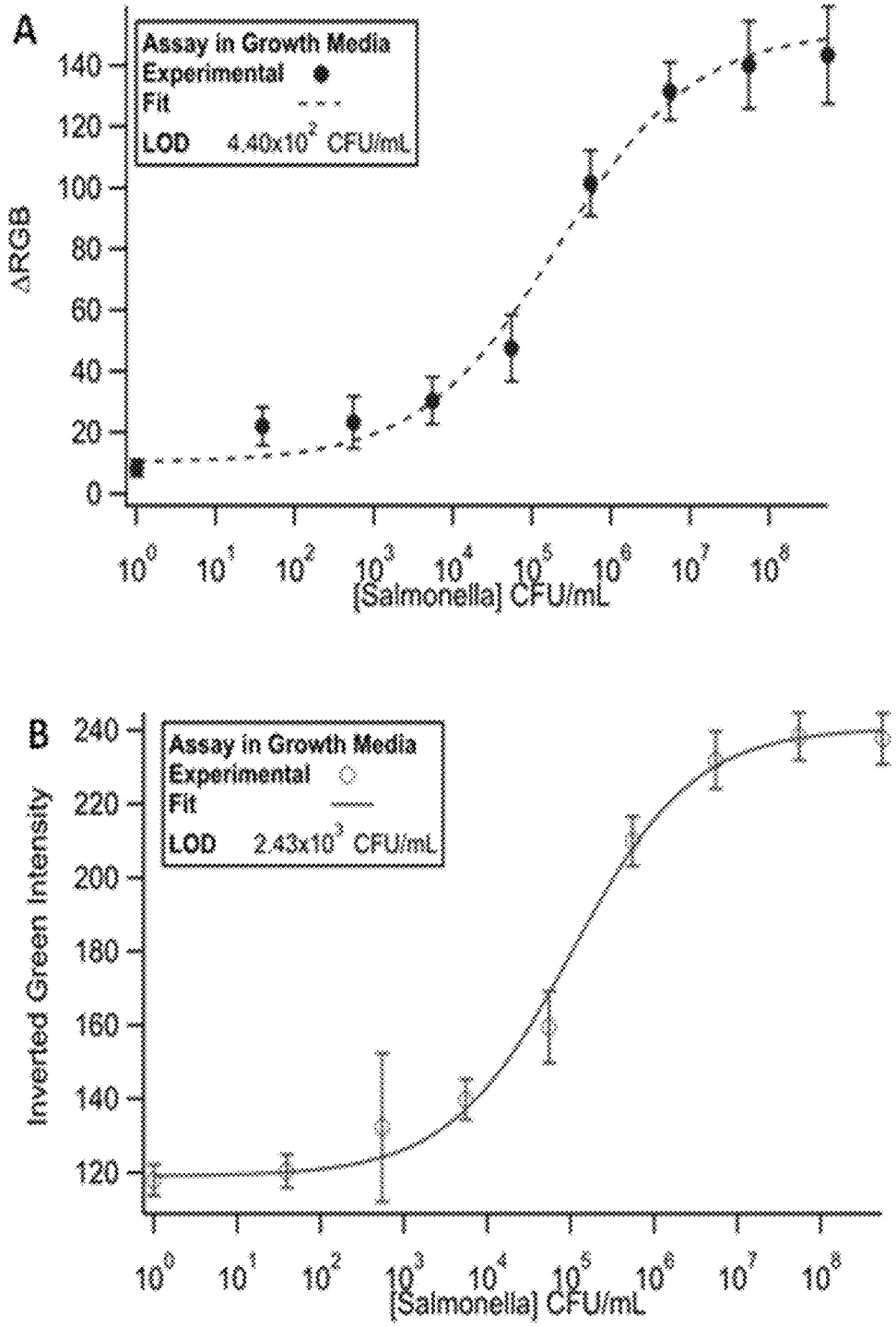
FIG. 11. illustrates a dose response curves created using ARGB (A.) and inverted green (B.)

When compared to manual analysis using NIH ImageJ, the automated algorithm returned nearly identical results (FIG. 10). The signal in each trial was defined as the difference in color between the blank and the sample. The vector length in 3D RGB space between the blank RGB coordinates and the sample was used to quantify this difference.

Figure 8:
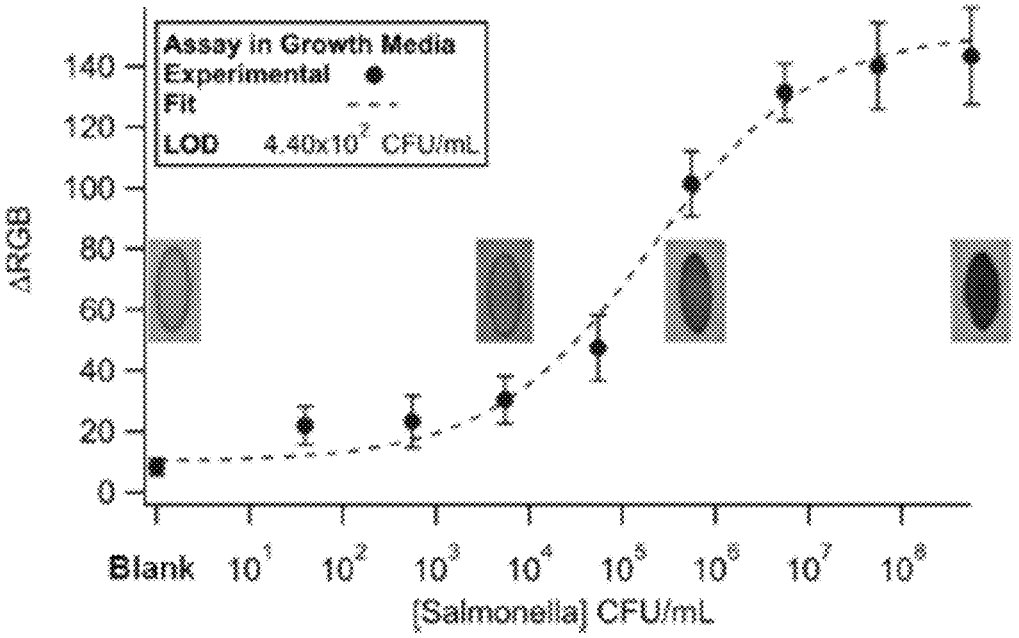
FIG. 8 illustrates a dose response curve (n=3) for *Salmonella* in media detected using the rotational manifold. The curve was fit to a 4-parameter logistic model and a LOD of 2.9×103 was achieved.

RGB coordinates (ΔRGB) were calculated using Equation 1:

$$\Delta RGB=\sqrt{(R_s-R_0)^2+(G_s-G_0)^2+(B_s-B_0)^2} \quad (1)$$

where $R_s$, $G_s$, and $B_s$ are the RGB values for the sample being tested, and $R_0$, $G_0$, and $B_0$ are the RGB values for each blank. The magnitude of the signal was larger for ΔRGB versus a single-color channel, thus increasing sensitivity. Additionally, equation 1 yields 9 data points with only 3 repeats ($\Delta S_1B_1$, $\Delta S_1B_2$, $\Delta S_1B_3$, $\Delta S_2B_1$, $\Delta S_2B_2$, $\Delta S_2B_3$, $\Delta S_3B_1$, $\Delta S_3B_2$, $\Delta S_3B_3$). The larger signal and number of data points resulted in an order of magnitude improvement in detection limit when compared to the use of a single channel (FIG. 8).

Results and Discussion.

Figure 6:
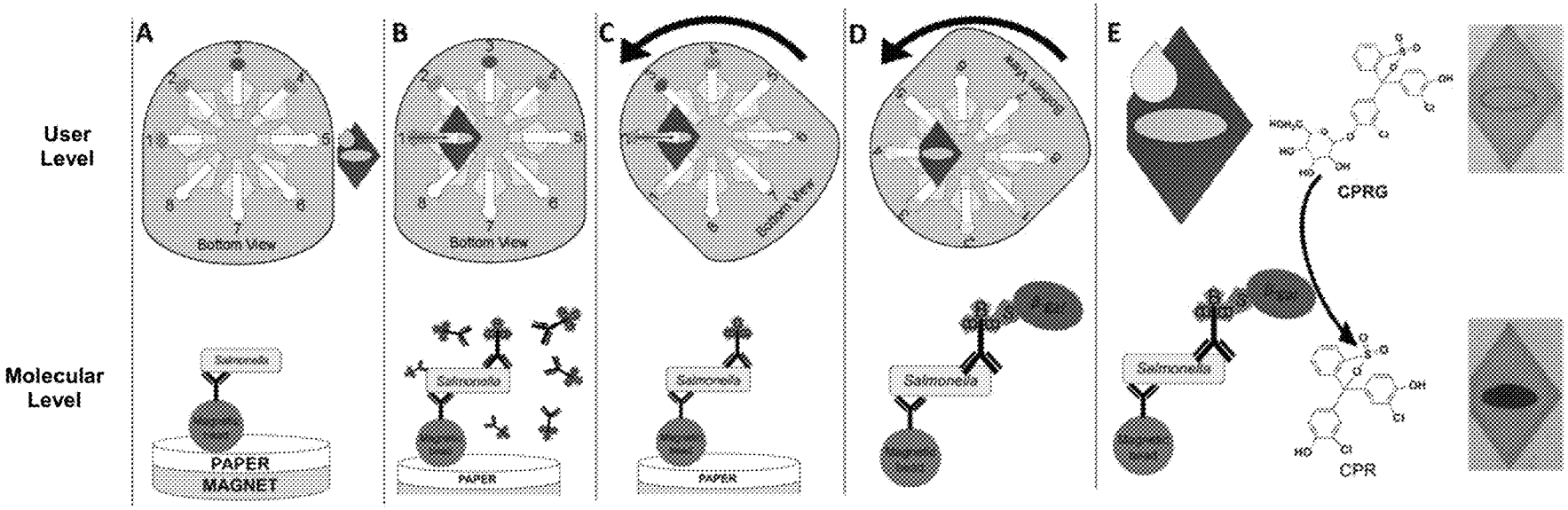
FIG. 6 illustrates the sequential reagent delivery using a rotating reagent storage card and a stationary sample layer (A.) Add sample containing magnetic beads conjugated to your target analyte to the sample layer. (B.) Add the sample layer to the apparatus. Biotinylated antibodies will be introduced. (C.) Rotate the apparatus to a washing step used to remove excess biotinylated antibodies. (D.) Continue rotating until streptavidin p-galactosidase has been introduced and washed. (E.) Remove sample layer, add substrate CPRG, and observe color change.

Immuno-magnetic separation sandwich immunoassay for *Salmonella* detection were performed as described in Srisa-Art et al., *Highly Sensitive Detection of Salmonella typhimurium Using a Colorimetric Paper-Based Analytical Apparatus Coupled with Immunomagnetic Separation. Analytical Chemistry* 2018, 90 (1), 1035-1043. Briefly, *Salmonella* may be isolated from a sample using *Salmonella*-antibody labeled magnetic beads. After a short incubation with the sample containing *Salmonella*, the beads are removed from solution with an external magnet, washed, and reconstituted in a small volume of buffer to concentrate the sample. A secondary *Salmonella*-antibody labeled with biotin may then be introduced to the *Salmonella*-magnetic bead complex solution. After an incubation and washing step, streptavidin-labeled β-galactosidase may be added to the *Salmonella*-magnetic bead-biotin conjugate solution. Finally, after another incubation and washing step, a small volume of the *Salmonella*-magnetic bead-biotin-β-galactosidase conjugate solution reacts with the substrate CPRG. After a set reaction time, a color change from yellow to red indicates the presence of β-galactosidase, and therefore *Salmonella*. Previously, all steps of the assay were performed in solution in a microcentrifuge tube until the final step, where a small aliquot of magnetic bead-*Salmonella*-enzyme conjugate was added to a paper spot with dried substrate. Such an assay worked but required some thirteen pipetting steps. The rotational manifold described herein greatly minimized the pipetting steps by washing and delivering reagents to the test zone (FIG. 6). Here, the initial step of sample incubation with antibody-labeled magnetic beads remains in-solution to ensure a sufficient number of bacteria are available for conjugation to the magnetic beads. After the bacteria is isolated from the sample, a 15 μL aliquot of the magnetic bead-bacteria complex is added to the paper testing area in the sample chamber and the remaining steps are completed in the apparatus.

Figure 12:
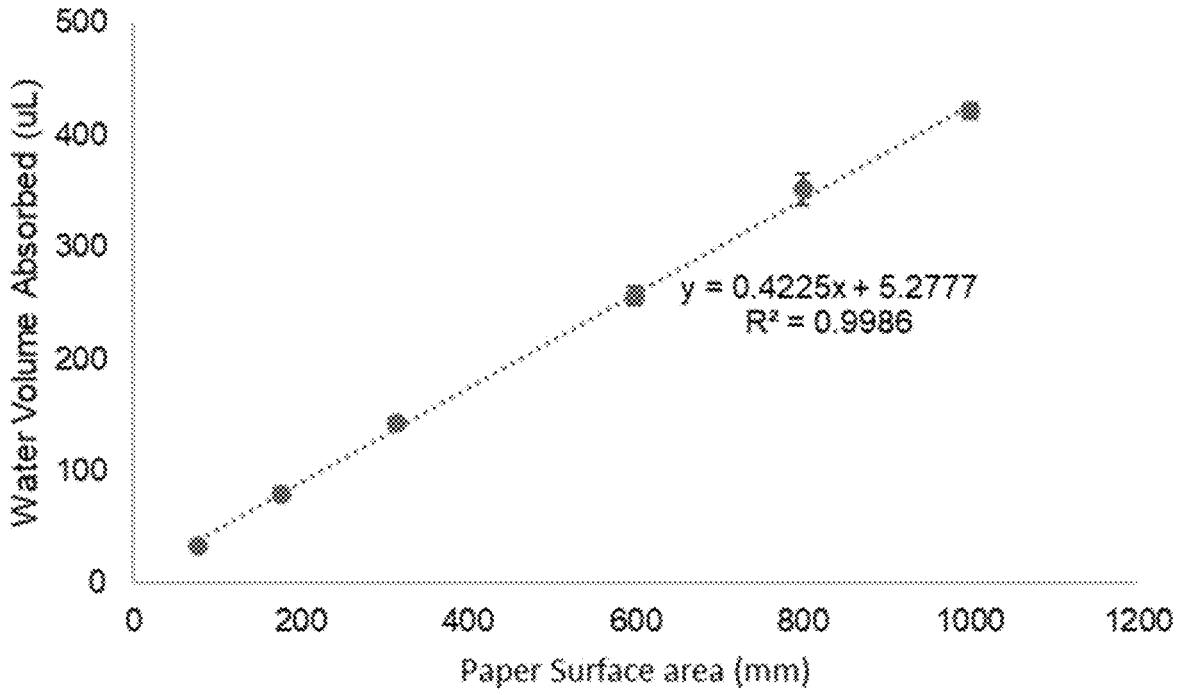
FIG. 12. illustrates the buffer volume/$mm^2$ absorbed by an absorption pad material.
Figure 13:
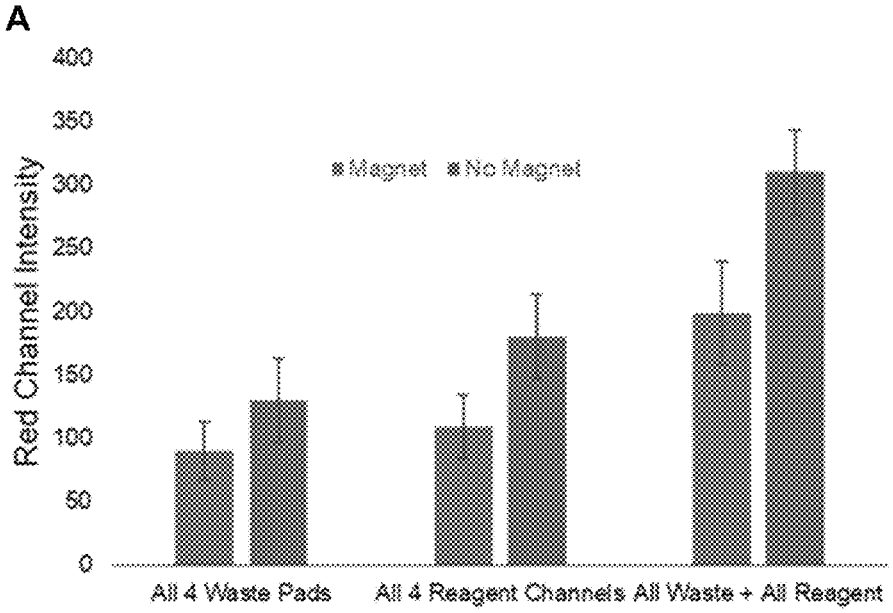
FIG. 13. illustrates magnetic bead retention with and without a magnet. (A.)
Figure 13:
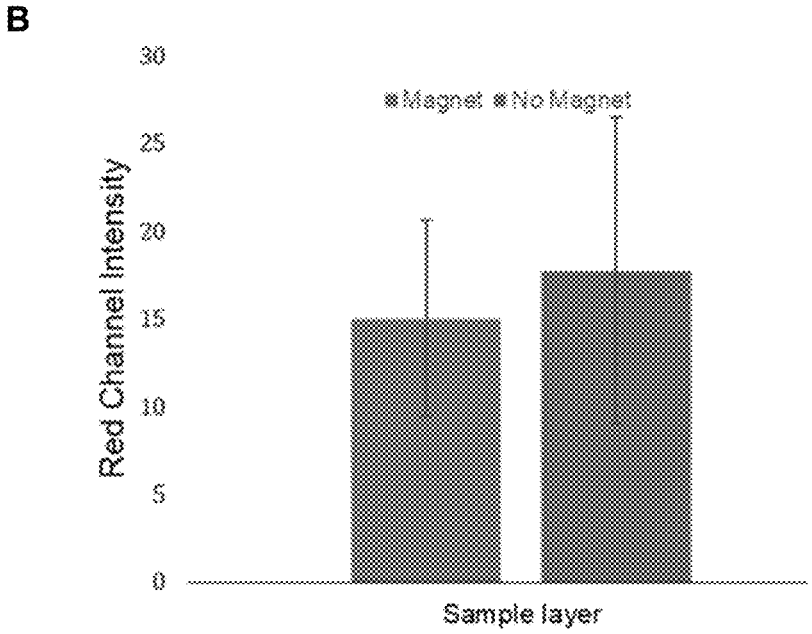

An important feature of the apparatus is that the buffer volume delivered in each step can be controlled by changing the size of the waste pad. For example, Fusion 5 Paper™ holds 0.422±0.006 μL/mm$^2$ (FIG. 12), thus, the volume of buffer used in each step may be customized by changing the surface area of the waste pad. Volume control of each reagent delivery and washing step is critical when using the apparatus for different assays that may need more thorough washing. Exemplary flow through each layer of the apparatus is illustrated in FIG. 5. The reagent card placed in the middle layer and positioned above the sample chamber fitted into the bottom manifold layer with lego-style fittings, friction fit, or other known means. A magnet may be positioned (e.g., screwed into the bottom of the insert) directly underneath the sample chamber. The magnet may ensure that any magnetic beads that are used in an assay are not washed away during reagent delivery and washing steps (FIG. 13). Advantageously, using magnetic beads and magnets to create a test zone permits the use of membranes other than nitrocellulose. Additionally, the test sample in the manifold is stationary in the sample chamber and, therefore, will not be lost to the membrane during flow through the apparatus as is the case in traditional lateral flow devices. Sample loss to paper channels is a problem in paper-based devices, and a stationary sample—such as is described with the present invention—may improve detection limits.

After the final washing step, the reagent card and sample chamber may be removed from the apparatus. 25 μL of 2.5 mM CPRG is pipetted onto the sample chamber containing the conjugated system. After this final pipetting step, the substrate reacts with any enzyme present for 40 min. A picture then may be captured of the sample chamber inside a light box. The image may be analyzed as described in the materials and methods to determine the *Salmonella* concentration. Using the rotational manifold, the number of pipetting steps needed to complete the IMS sandwich immunoassay decreased from 13 to 4, this reducing the amount of time, labor, and steps that may lead to spillage, contamination, or other error.

Fusion 5 Paper™ was chosen as the paper type for all portions of the manifold: reagent card, waste pads, and testing area. Fusion 5 Paper™ was developed as a substrate for all portions of a lateral flow assay. In the disclosed devices, Fusion 5 Paper™ demonstrated faster flow and lower noise from non-specific enzyme adsorption than other papers tested (Whatman I and IV). The faster flow rates increased washing efficiency and decreased assay time. Additionally, Fusion 5 Paper™ contains plastic binder meant to stabilize its mechanical properties, permitting lamination of the reagent layer under high pressure and heat without decreasing flow rates.

Figure 7:
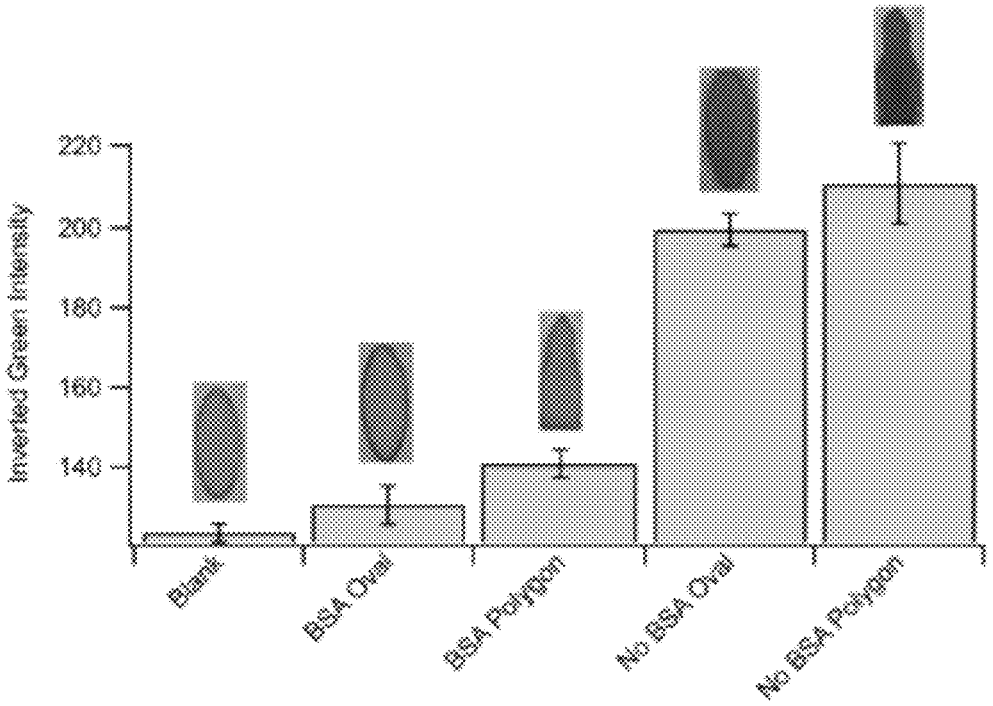
FIG. 7 illustrates the effect of sample layer shape and blocking with BSA. The blank sample was an image of the sample layer with CPRG without any β-Galactosidase ever introduced. All other samples had β-Galactosidase washed through the sample layer into the waste pads.

A major challenge in developing the rotational manifold and corresponding assay included minimizing the noise in the blank signal. Although using Fusion 5 Paper™ helped improve washing, β-galactosidase would consistently get trapped on the edges or ends of the testing area of the sample chamber. To overcome this challenge, the surface of the sample testing was blocked with 10 μL of 5 mg/mL bovine serum albumin (BSA) and shape to an oval pattern. The benefit of an oval testing area is that there are no corners to trap the enzymes. Once these changes were implemented, the washing efficiency of the apparatus was improved, and blank samples remained yellow after all washing steps were performed (FIG. 7).

Figure 14:
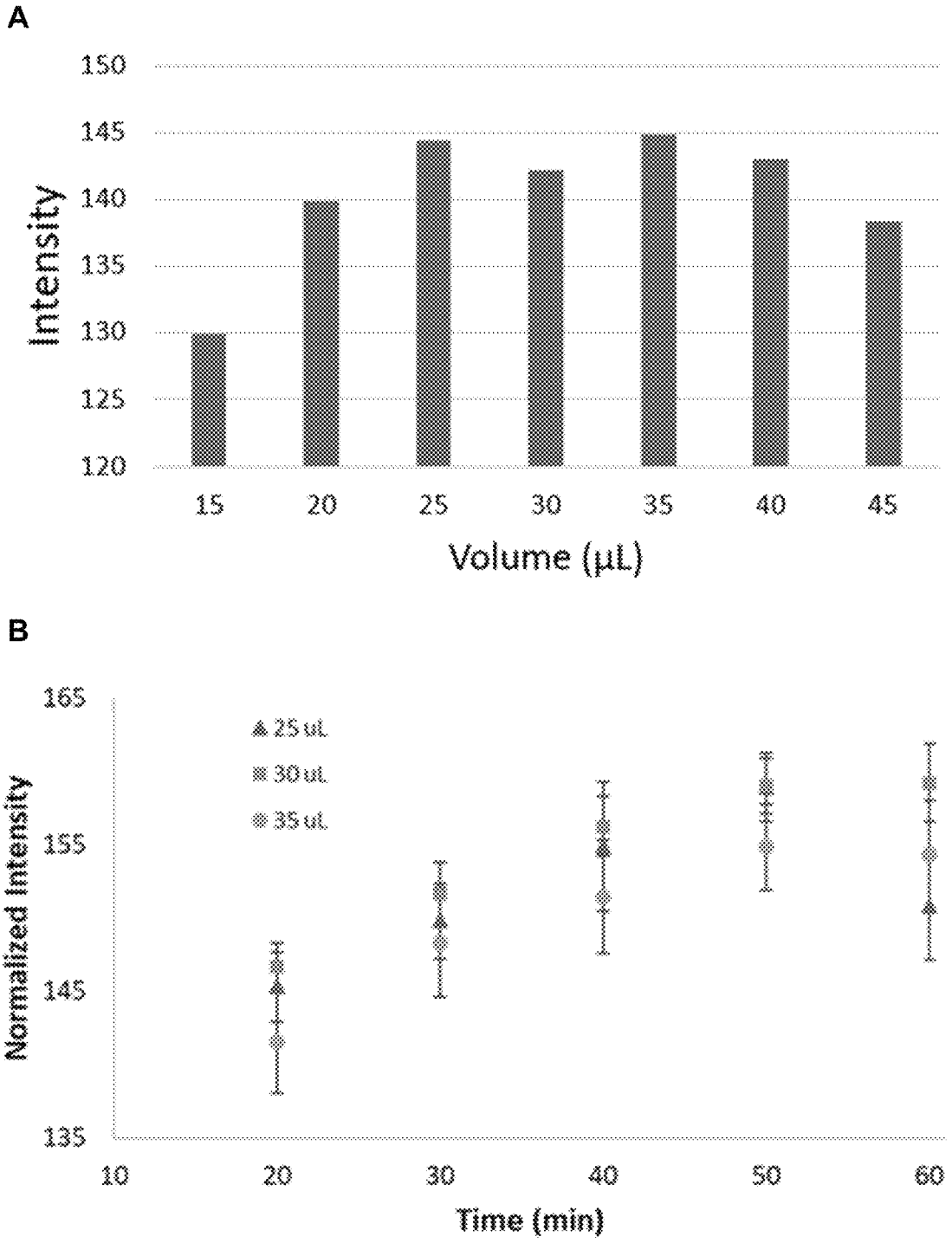
FIG. 14. illustrates CPRG volume (A.) and time (B.) optimization. CPRG concentration was 2.5 mM and 0.2 μg of Streptavidin β-galactosidase was reacted on each sample layer. The volume of CPRG and reaction time were varied.

The initial test sample incubation with the magnetic beads was 15 min. In more complex test samples, this incubation may need to be lengthened. The reaction times for each reagent delivery step were roughly 2 min, or the time it took for the waste pad to completely saturate. Once saturated, flow through the waste pad stopped and no new reagents reached the immobilized magnetic bead complex, eliminating any benefit of longer incubation. The shape of the waste pad was fan-like to provide continuous capillary pressure and more constant flow rates. Finally, the substrate and enzyme reacted for 40 min. In optimization studies of CPRG and β-galactosidase the longer the wait time the higher the signal, so long as the sample layer did not dry out. Above 25 μL of substrate, the sample layer began to leak, and at 25 μL the sample began to dry out after 60 min (FIG. 14). The 40-min reaction time was a compromise between assay speed and sensitivity. If total assay time was not a concern, a user may lower detection limits by increasing the reaction time and minimizing evaporation with a small air-tight enclosure. With the 40-min reaction, the entire assay can be performed in roughly 65 min. In samples with higher bacteria concentrations, a qualitative color change could be observed in as little as 5 min after adding the substrate. To reach a lower limit of detection, however, 40 min of reaction time was needed to differentiate between the blank and the lowest bacteria concentration.

An image captured by an image capture apparatus (e.g., a smartphone) was used to quantify *Salmonella*. Smartphones are an excellent tool for in-field measurements as most end-users will already own a such an apparatus, cutting down on the cost of the assay and increasing user-friendliness. Differences in ambient lighting may be correct with, for example, a light box that contains an opening for a smart phone to take a picture. The light-box improved consistency between images as shown in Table 1. The % RSD of three identical blank images of the sample layer taken in three different ambient light settings decreased from 19.9% without the box to 3.3% in the box.

TABLE 1

Inverted green intensity of the same sample layer in multiple ambient light environments inside and outside the light box.

| | Ambient Light | Light Box |
|---|---|---|
| Image 1: Fluorescent light | 111.1 | 126.2 |
| Image 2: Traditional bulb | 163.1 | 126.1 |
| Image 3: Direct sunlight | 158.2 | 133.5 |
| Average | 144.1 | 128.5 |
| SD | 28.7 | 4.2 |
| % RSD | 19.9% | 3.3% |

A *Salmonella* detection assay was used to test the functionality of the manifold. Here, *Salmonella* cultured in Difco nutrient broth was diluted to concentrations spanning from $10^2$ to $10^7$ CFU/mL. The results are shown in FIG. 8 (n=3). The data was fit to a 4-parameter logistic curve (Equation 2) with a $X^2$=13.02 ($\alpha$=0.05, $X_{critical}$=15.51).

$$\text{Signal} = d + \frac{a-d}{1+\left(\frac{T}{c}\right)^b} \tag{2}$$

Signal is the intensity of the colored sample layer, T is the target (*Salmonella*) concentration, and a-d are the 4 parameters defining the shape of the curve. The parameter a is the expected signal at T=0, b is the slope of the line at the center/steepest part of the curve, c is the target concentration at the center of the curve, and d is the maximum signal, i.e. when T is infinitely high. The logistic fit was chosen because the antibody binding kinetics of the sandwich immunoassay are the limiting steps. The LOD was calculated by finding 3×SD+mean of the blank and plugging it into the fit equation. An LOD of $4.40\times10^2$ CFU/mL was realized using the manifold. In previous experiments performed entirely using in-solution assay, the LOD was on the same order of magnitude, which demonstrates the capabilities of our apparatus to perform a multi-step immunoassay on an mPAD.

Figure 9:
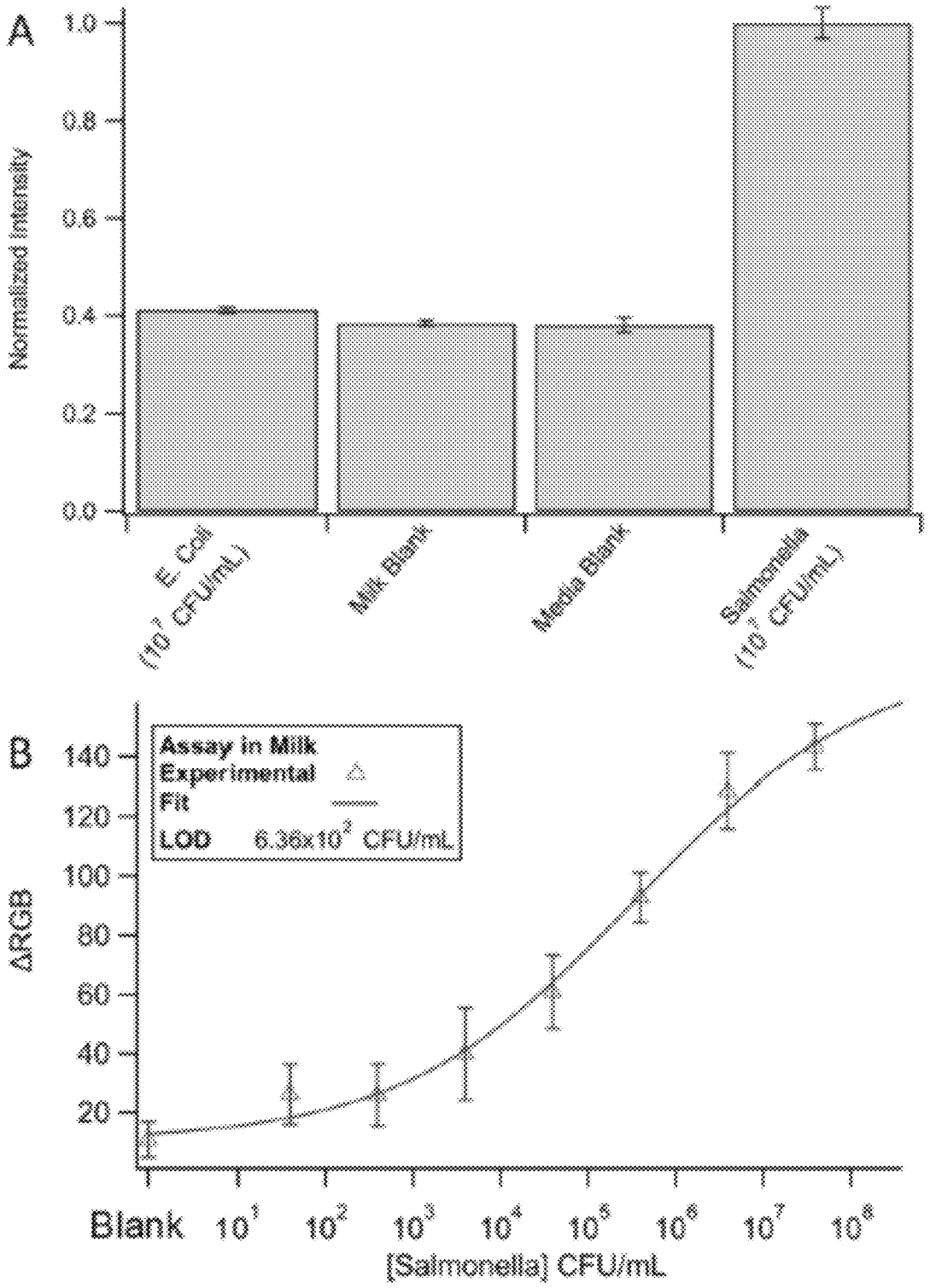
FIG. 9 illustrates (A.) Specificity study using *E. Coli* at 107 CFU/mL compared to blank samples in milk, growth media, and a positive *Salmonella* sample. (B.) Dose-response curve (n=3) of *Salmonella* in milk detected using the rotational manifold. The curve was fit to a 4-parameter logistic model and a LOD of 6.4×102 CFU/mL was achieved.

To confirm the specificity of the *Salmonella* assay, $10^7$ CFU/mL DH5 α *E. Coli* in media was tested with the apparatus using *Salmonella* specific antibodies (FIG. 9). The low signal for *E. Coli* samples demonstrates the specificity of the assay. A low signal also indicates efficient washing throughout the system as *E. Coli* produces β-galactosidase naturally, and any excess enzyme would increase the signal.

Finally, the assay was conducted using milk spiked with *Salmonella* (FIG. 9). In milk, the detection limit was found to be $6.36\times10^2$ CFU/mL. The data was fit to a 4-parameter logistic curve ($X^2$=4.13 ($\alpha$=0.05, $X_{critical}$=14.07) and the LOD found using the curve and 3×SD+the mean of the blank. Although the detection limit is slightly higher, the assay performed nearly as well in milk versus growth media.

The small difference in LOD could be attributed to decreased antibody binding efficiency in the first step of the assay due to non-specific adsorption of other biomolecules onto the magnetic beads.

While the manifold was used to detect *Salmonella*, simple changes of reagents permit a user to detect a large host of other pathogens, proteins, or other biomarkers.

It is noted that the disclosure is susceptible to various modifications and alternative forms, specific exemplary embodiments of the invention have been shown by way of example in the drawings and have been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

All cited journal articles, patents, and patent publications discussed herein are incorporated by reference in their entirety.

What is claimed is:

1. A microfluidic apparatus comprising:

a housing having a top layer, a middle layer, and a bottom layer, wherein each of the top layer, the middle layer and bottom layer are substantially planar and oriented perpendicular to a central vertical rotational axis;

the middle layer comprising a removable microfluidic layer, the removable microfluidic layer including a plurality of reagent channels and a plurality of absorption pads, the plurality of reagent channels and the plurality of absorption pads disposed within the removable microfluidic layer and arranged radially about the central vertical rotational axis, and one or more reagents dried on a surface of the plurality of reagent channels;

the bottom layer comprising a fluid reservoir, and a removable sample insert including a sample chamber for receiving a test sample;

wherein the middle layer is rotatable about the central vertical rotational axis in relation to the bottom layer and the top layer to align vertically one of the plurality of reagent channels and one of the plurality of absorption pads with the sample chamber so that the one of the plurality of reagent channels, the one of the plurality of absorption pads, the fluid reservoir, and the sample chamber are in fluid communication with one another; and wherein the middle layer includes a plurality of integral male and female engagement surfaces that interlock with a complementary plurality of integral male and female engagement surfaces of the top layer and the bottom layer to secure the top layer, the bottom layer, and the middle layer in vertical alignment, wherein the plurality of integral male and female engagement surfaces of the middle layer and the complementary plurality of integral male and female engagement surfaces of the top layer and the bottom layer are arranged to permit rotation of the middle layer in relation to the top layer and the bottom layer.

2. The microfluidic apparatus of claim 1 wherein the removable microfluidic layer comprises a laminate material including one or more of a paper membrane, transparency sheets, lamination sheets, or a combination thereof.

3. The microfluidic apparatus of claim 1 wherein the surface of the plurality of reagent channels is hydrophobic.

4. The microfluidic apparatus of claim 1 wherein the one or more reagents include a detection molecule labeled with an enzyme, a fluorophore, or a colored particle to permit colorimetric assessment of an analyte presence or concentration in the test sample loaded in the sample chamber.

5. The microfluidic apparatus of claim 1 wherein the one or more reagents comprise a wash buffer.

6. The microfluidic apparatus of claim 4 wherein the analyte is selected from the group consisting of small molecules, proteins, lipids, polysaccharides, polynucleotides, prokaryotic cells, eukaryotic cells, particles, viruses, metal ions, and combinations thereof.

7. The microfluidic apparatus of claim 1 wherein the sample insert further comprises a magnet disposed beneath the sample chamber.

8. The microfluidic apparatus of claim 1 wherein the sample chamber includes magnetic beads disposed on a surface of the sample chamber.

9. The microfluidic apparatus of claim 8 wherein the magnetic beads are at least partially coated with a capture molecule.

10. The microfluidic apparatus of claim 9 wherein the capture molecule includes one or more of an antibody, an antigen, an aptamer, or a polynucleotide.

11. A microfluidic apparatus comprising:

a housing having a top layer, a middle layer, and a bottom layer, wherein each of the top layer, the middle layer and bottom layer are substantially planar and oriented perpendicular to a central vertical rotational axis;

the middle layer comprising a removable microfluidic layer, the removable microfluidic layer including a plurality of reagent channels and a plurality of absorption pads, the plurality of reagent channels and the plurality of absorption pads disposed within the removable microfluidic layer and arranged radially about the central vertical rotational axis, and one or more reagents dried on a surface of the plurality of reagent channels;

the bottom layer comprising a fluid reservoir, and a removable sample insert including a sample chamber for receiving a test sample;

wherein the middle layer is rotatable about the central vertical rotational axis in relation to the bottom layer and the top layer to align vertically one of the plurality of reagent channels and one of the plurality of absorption pads with the sample chamber so that the one of the plurality of reagent channels, the one of the plurality of absorption pads, the fluid reservoir, and the sample chamber are in fluid communication with one another; and wherein the middle layer includes a plurality of integral male and female engagement surfaces that interlock with a complementary plurality of integral male and female engagement surfaces of the top layer and the bottom layer to secure the top layer, the bottom layer, and the middle layer in vertical alignment, the plurality of integral male and female engagement surfaces of the middle layer and the complementary plurality of integral male and female engagement surfaces of the top layer and the bottom layer are arranged such that rotation of the middle layer in relation to the top layer and the bottom layer is in 45-degree increments.

12. The microfluidic apparatus of claim 1 wherein the bottom layer further comprises a wicking channel disposed between the fluid reservoir and the plurality of reagent channels.

13. The microfluidic apparatus of claim 1 wherein the housing is three-dimensionally printed from a material selected from the group consisting of resin, acrylonitrile butadiene styrene, thermoplastic elastomers, thermoplastic polyurethane, poly lactic acid, high impact polystyrene, polyethylene terephthalate, glycol modified polyethylene terephthalate, nylon, carbon fiber, acrylic styrene acrylonitrile, polycarbonate, polypropylene, poly vinyl acetate, or a combination thereof.

14. A method of analyzing a test sample comprising introducing the test sample to the sample chamber of claim 1 and contacting the test sample with at least one of the one or more reagents.

15. The method of analyzing a test sample according to claim 14 wherein the middle layer is rotated relative to the top layer and the bottom layer to sequentially align vertically each of the plurality of reagent channels with the sample chamber.

16. The method of analyzing a test sample according claim 15 wherein the sample layer further comprises a magnet disposed beneath the sample chamber.

17. The method of analyzing a test sample according claim 15 wherein the sample chamber includes magnetic beads disposed on a surface of the sample chamber.

18. The method of analyzing a test sample according to claim 17 wherein the magnetic beads are at least partially coated with a capture molecule, the capture molecule including one or more of an antibody, an antigen, an aptamer, or a polynucleotide.

19. The microfluidic apparatus of claim 1, wherein the integral male and female engagement surfaces of the middle layer and the complementary integral male and female engagement surfaces of the top layer and the bottom layer are arranged such that rotation of the middle layer in relation to the top layer and the bottom layer is in about 10-degree to about 180-degree increments.

20. The microfluidic apparatus of claim 19, wherein the rotation of the middle layer in relation to the top layer and the bottom layer is in about 10-degree to about 60-degree increments.

* * * * *